US011586140B2

(12) United States Patent
Maeda

(10) Patent No.: US 11,586,140 B2
(45) Date of Patent: Feb. 21, 2023

(54) ATTACHMENT, SET OF MOUNTABLE AND DISMOUNTABLE UNITS, ELECTROPHOTOGRAPHIC IMAGE FORMING APPARATUS AND CARTRIDGE MOUNTING METHOD

(71) Applicant: CANON KABUSHIKI KAISHA, Tokyo (JP)

(72) Inventor: Naoki Maeda, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/012,193

(22) Filed: Sep. 4, 2020

(65) Prior Publication Data

US 2020/0401080 A1 Dec. 24, 2020

Related U.S. Application Data

(63) Continuation of application No. PCT/JP2019/014902, filed on Mar. 28, 2019.

(30) Foreign Application Priority Data

Mar. 29, 2018 (JP) ..... JP2018-066097

(51) Int. Cl.
*G03G 21/18* (2006.01)

(52) U.S. Cl.
CPC ..... *G03G 21/1846* (2013.01); *G03G 21/186* (2013.01); *G03G 21/1821* (2013.01);
(Continued)

(58) Field of Classification Search
CPC ..... G03G 21/1821; G03G 21/1839; G03G 21/1842; G03G 21/1853; G03G 21/1857;
(Continued)

(56) References Cited

U.S. PATENT DOCUMENTS 6,511,227 B1 * 1/2003 Siow ..... F16C 33/20 384/428
10,175,629 B2 * 1/2019 Nieda ..... G03G 21/1647
(Continued)

FOREIGN PATENT DOCUMENTS

CN 201066435 Y 5/2008
CN 203894537 U 10/2014
(Continued)

OTHER PUBLICATIONS

Aug. 19, 2021 Office Action in Taiwanese Patent Application No. 109138833.
(Continued)

*Primary Examiner* — Carla J Therrien
(74) *Attorney, Agent, or Firm* — Venable LLP

(57) ABSTRACT

A mountable unit set usable with an electrophotographic-image-forming apparatus includes a cartridge and an attachment. A cartridge includes a photosensitive drum and a coupling member for receiving a driving force for rotating the photosensitive drum, from a driving shaft. An attachment includes a cylindrical portion for being mounted to a periphery of the driving shaft to suppress tilting of the driving shaft. Tilting of a driving-force transmitting member is suppressed.

11 Claims, 25 Drawing Sheets

(52) U.S. Cl.
CPC ..... *G03G 21/1853* (2013.01); *G03G 21/1857* (2013.01); *G03G 2221/1846* (2013.01)

(58) Field of Classification Search
CPC ..... G03G 21/186; G03G 21/1864; G03G 2221/1846
See application file for complete search history.

(56) References Cited

U.S. PATENT DOCUMENTS

| | | | | |
|---|---|---|---|---|
| 2001/0021320 | A1* | 9/2001 | Murayama | G03G 21/185 399/117 |
| 2007/0019990 | A1 | 1/2007 | Murofushi | |
| 2009/0028592 | A1 | 1/2009 | Nakajima | |
| 2009/0028597 | A1* | 1/2009 | Takigawa | G03G 21/1864 399/90 |
| 2011/0038649 | A1 | 2/2011 | Miyabe et al. | |
| 2014/0294444 | A1* | 10/2014 | Kawai | G03G 15/757 399/167 |
| 2016/0169364 | A1 | 6/2016 | Kataoka | |
| 2016/0370757 | A1 | 12/2016 | Sato et al. | |
| 2017/0261926 | A1 | 9/2017 | Kashiide et al. | |
| 2017/0293256 | A1* | 10/2017 | Shida | G03G 21/1676 |
| 2017/0351214 | A1* | 12/2017 | Uesugi | G03G 15/00 |
| 2018/0039199 | A1 | 2/2018 | Ai et al. | |
| 2019/0129356 | A1 | 5/2019 | Murakami et al. | |
| 2019/0179257 | A1* | 6/2019 | Murakami | G03G 21/1864 |

FOREIGN PATENT DOCUMENTS

| | | | |
|---|---|---|---|
| CN | 104614961 | A | 5/2015 |
| CN | 107678257 | A | 2/2018 |
| CN | 107748488 | A | 3/2018 |
| EP | 3 264 185 | A | 1/2018 |
| JP | 2009-025704 | A | 2/2009 |
| JP | 2009-270594 | A | 11/2009 |
| JP | 2019-270594 | A | 11/2009 |
| JP | 2010-121651 | A | 6/2010 |
| JP | 2015-111221 | A | 6/2015 |
| JP | 2016-114239 | A | 6/2016 |
| JP | 2017-142473 | A | 8/2017 |
| JP | 2017-223952 | A | 12/2017 |
| TW | 201523172 | A | 8/2015 |
| TW | 201635059 | A | 10/2016 |
| TW | 201809923 | A | 3/2018 |
| TW | 201809928 | A | 3/2018 |

OTHER PUBLICATIONS

Nov. 10, 2021 Extended Search Report in European Patent Application No. 19 774 413.9.
Dec. 27, 2019 Office Action in Taiwanese Patent Application No. 108111134.
Jan. 18, 2022 Office Action in Japanese Patent Application No. 2018-066097.
International Search Report and Written Opinion for the International Searching Authority for International Patent Application No. PCT/JP2019/014902.
Nov. 29, 2022 Office Action in Chinese Patent Application Pub. No. 201980018361.X (with English translation).

* cited by examiner

ATTACHMENT, SET OF MOUNTABLE AND DISMOUNTABLE UNITS, ELECTROPHOTOGRAPHIC IMAGE FORMING APPARATUS AND CARTRIDGE MOUNTING METHOD

TECHNICAL FIELD

The present invention relates to an attachment, a dismountably mountable unit set, an electrophotographic image forming apparatus, and a cartridge mounting method.

The attachment is mountable to and dismountable from the main assembly of the image forming apparatus (electrophotographic image forming apparatus).

The dismountably mountable unit set is a combination (set) of units which can be mounted to and dismounted from the apparatus main assembly of the image forming apparatus.

An image forming apparatus (electrophotographic image forming apparatus) is an apparatus capable of forming an image on a recording material using an electrophotographic image forming process. For example, an electrophotographic copying machine, an electrophotographic printer (LED printer, laser beam printer, and so on), a facsimile machine, a word processor, and so on are included.

BACKGROUND OF INVENTION

In the electrophotographic image forming apparatus (hereinafter also simply referred to as "image forming apparatus"), an electrophotographic photosensitive member, which is generally a drum type as an image bearing member, that is, the photosensitive drum (electrophotographic photosensitive drum) is uniformly charged. Next, the electrostatic latent image (electrostatic image) is formed on the photosensitive drum by selectively exposing the charged photosensitive drum. Next, the electrostatic latent image formed on the photosensitive drum is developed into a toner image with toner as a developer. Then, the toner image formed on the photosensitive drum is transferred onto a recording material such as recording sheet or a plastic sheet, and heat or pressure is applied to the toner image transferred onto the recording material to fix the toner image on the recording material, thus effecting image recording operation.

Such an image forming apparatus generally requires toner replenishment and maintenance of various process means. In order to facilitate this toner replenishment and maintenance operations, a cartridge in which the photosensitive drum, charging means, developing means, cleaning means and so on are provided, and which is dismountable from the image forming apparatus main assembly, has been put into practical use.

According to this cartridge system, a part of the maintenance of the device can be performed by the user without relying on the service person in charge of the after-sales service. Therefore, the operability of the apparatus can be remarkably improved, and an image forming apparatus excellent in usability can be provided. Therefore, this cartridge system is widely used with the image forming apparatuses.

An example of the cartridge includes the cartridge. The process cartridge is a cartridge in which an electrophotographic photosensitive drum and process means which acts on the electrophotographic photosensitive drum are integrally formed into a cartridge, and the cartridge is dismountably mounted to the main assembly of the image forming apparatus.

In the above-described process cartridge, a structure in which a coupling member is provided at the free end of the photosensitive member drum to transmit the driving force from the apparatus main assembly to the photosensitive member drum is widely used. As described in JP-A-2017-223952, the driving force is transmitted from the drive transmission member of the image forming apparatus main assembly to the coupling member of the process cartridge.

SUMMARY OF THE INVENTION

Problem to be Solved

The present invention provides a further development of the above conventional structure.

Means for Solving the Problem

A typical structure disclosed in this application is a mountable unit set usable with an electrophotographic image forming apparatus, said mountable unit set comprising (1) a cartridge detachably mountable to an apparatus main assembly of the electrophotographic image forming apparatus, said cartridge including (1-1) a photosensitive drum, and (1-2) a coupling member for receiving a driving force for rotating the photosensitive drum from a driving shaft provided in the apparatus main assembly, and (2) an attachment mountable to through the apparatus main assembly and including (2-1) a cylindrical portion configured to be mounted around the driving shaft to suppress tilting of the driving shaft.

Another typical structure is an attachment detachably mountable to an apparatus main assembly of an electrophotographic image forming apparatus, said attachment comprising a cylindrical portion mountable to a driving shaft provided in said main assembly to suppress inclination of the driving shaft.

Further typical structure is a mountable unit set usable with an electrophotographic image forming apparatus, said mountable unit set comprising (1) a cartridge including (1-1) a photosensitive drum and (1-2) a coupling member for receiving a driving force for rotating said photosensitive drum; and (2) an attachment including (2) a cylindrical portion having opposite ends in the axial direction are open.

Further typical structure is an attachment usable with an electrophotographic image forming apparatus, said attachment comprising a cylindrical portion having the opposite ends in an axial direction thereof are open, and a grip portion extending from an outer periphery of said cylindrical portion toward an outside in a radial direction of said cylindrical portion.

In addition, a further typical method disclosed in this application is a cartridge mounting method comprising a step of suppressing a tilting of a driving shaft by mounting an attachment to the driving shaft provided in a main assembly of an electrophotographic image forming apparatus, and a step of mounting a cartridge to the main assembly of the apparatus to which the attachment has been mounted.

Effect of the Invention

The conventional structure can be developed.

Figure 6:
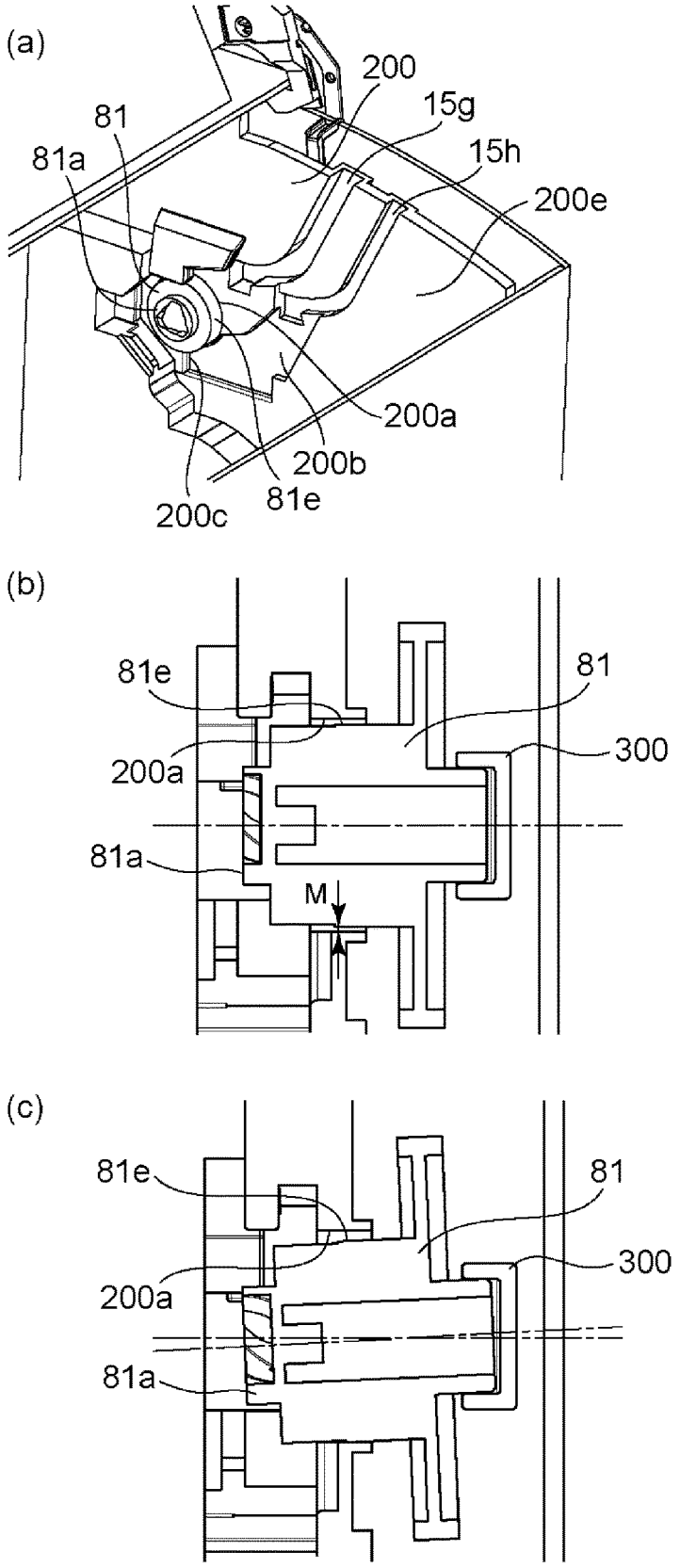

Part (a) of FIG. 6 is a perspective view of the apparatus main assembly A, part (b) is a sectional view of the apparatus main assembly, and part (c) is a sectional view of the apparatus main assembly.

Figure 7:
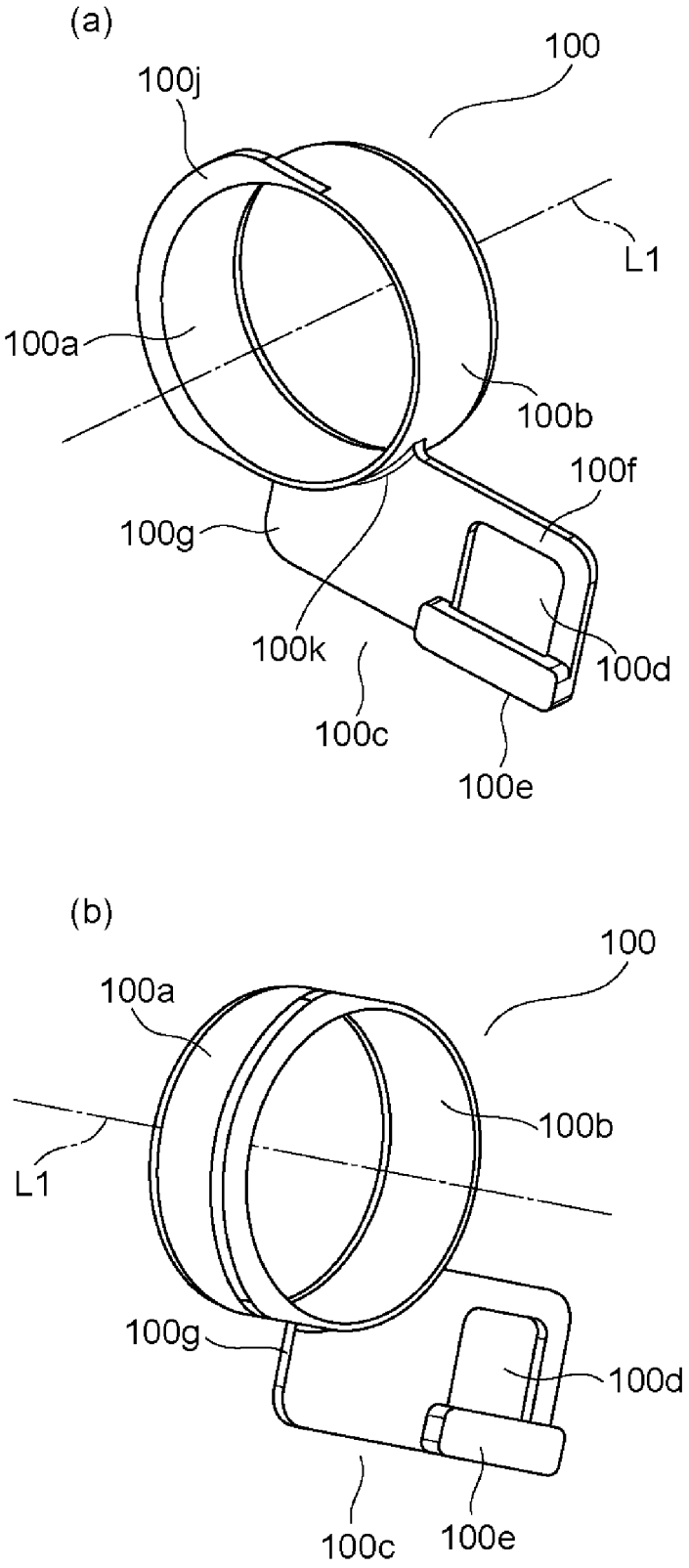

In FIG. 7, part (a) is a perspective view of an attachment, and part (b) is a perspective view of the attachment.

Figure 8:
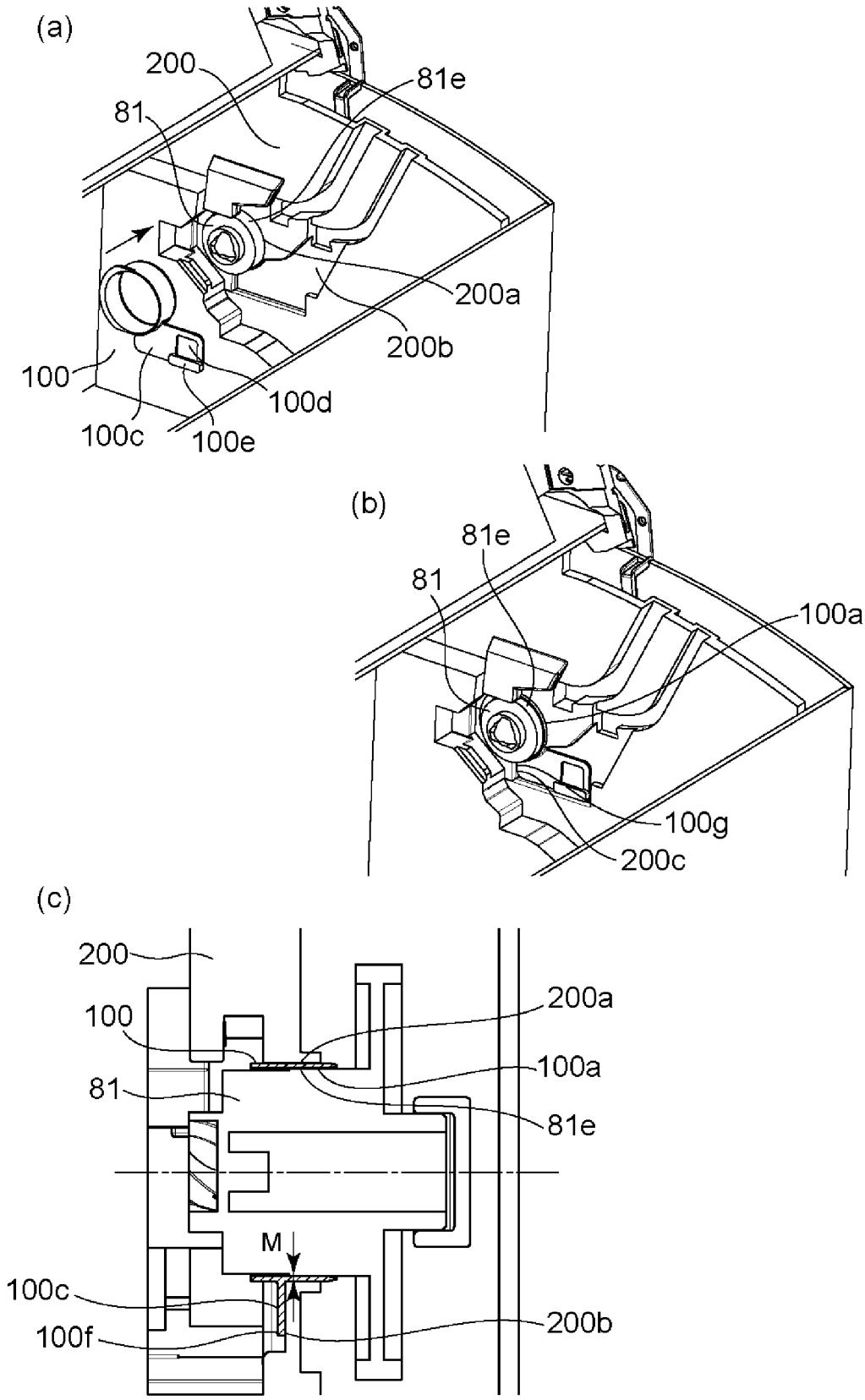

In FIG. 8, part (a) is a perspective view of the apparatus main assembly and the attachment, part (b) is a perspective view of the apparatus main assembly and the attachment, and part (c) is a cross-sectional view of the apparatus main assembly and the attachment.

Figure 9:
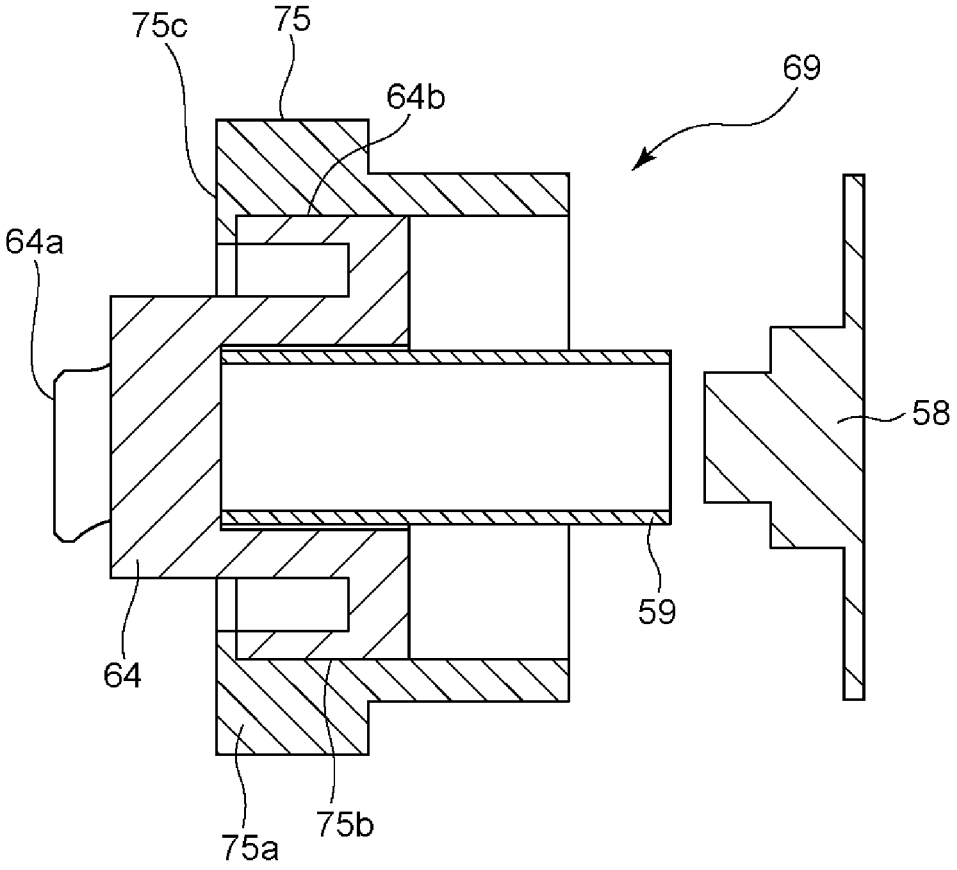

FIG. 9 is an illustration of the structure of the drive side flange unit.

Figure 10:
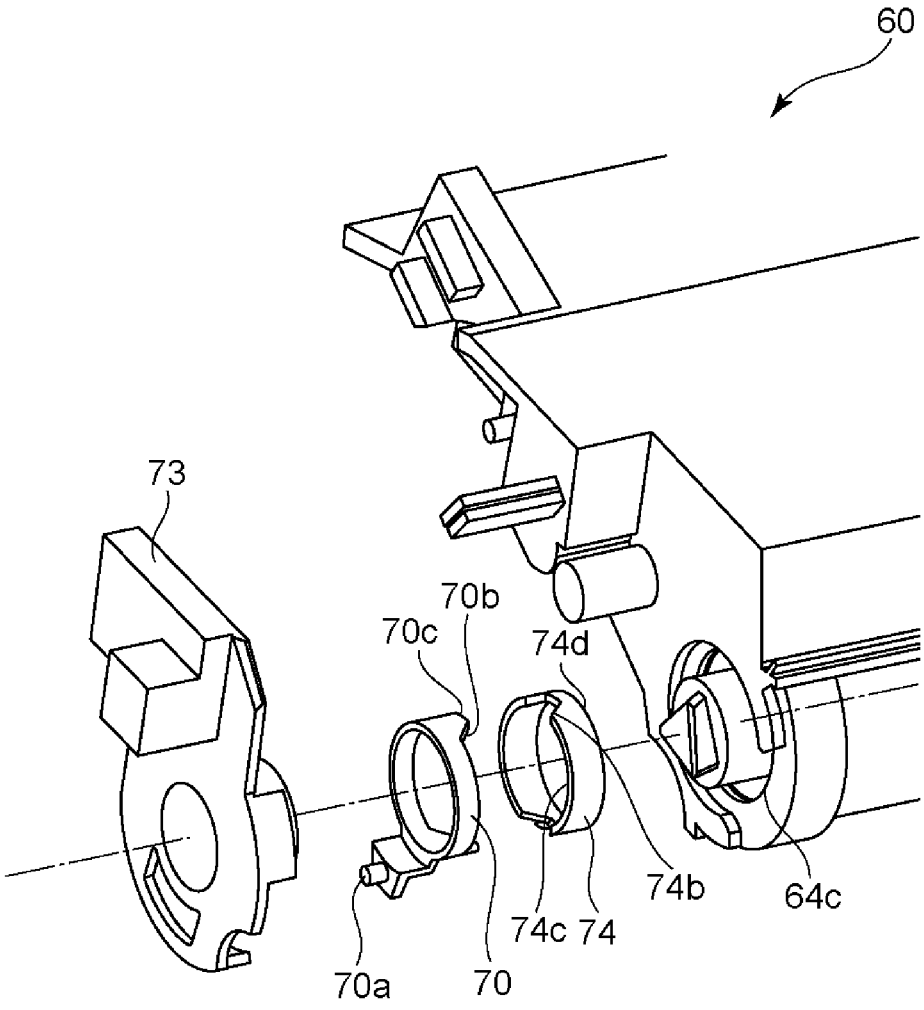

FIG. 10 is a partial perspective view of a cleaning unit including an operating unit.

Figure 11:
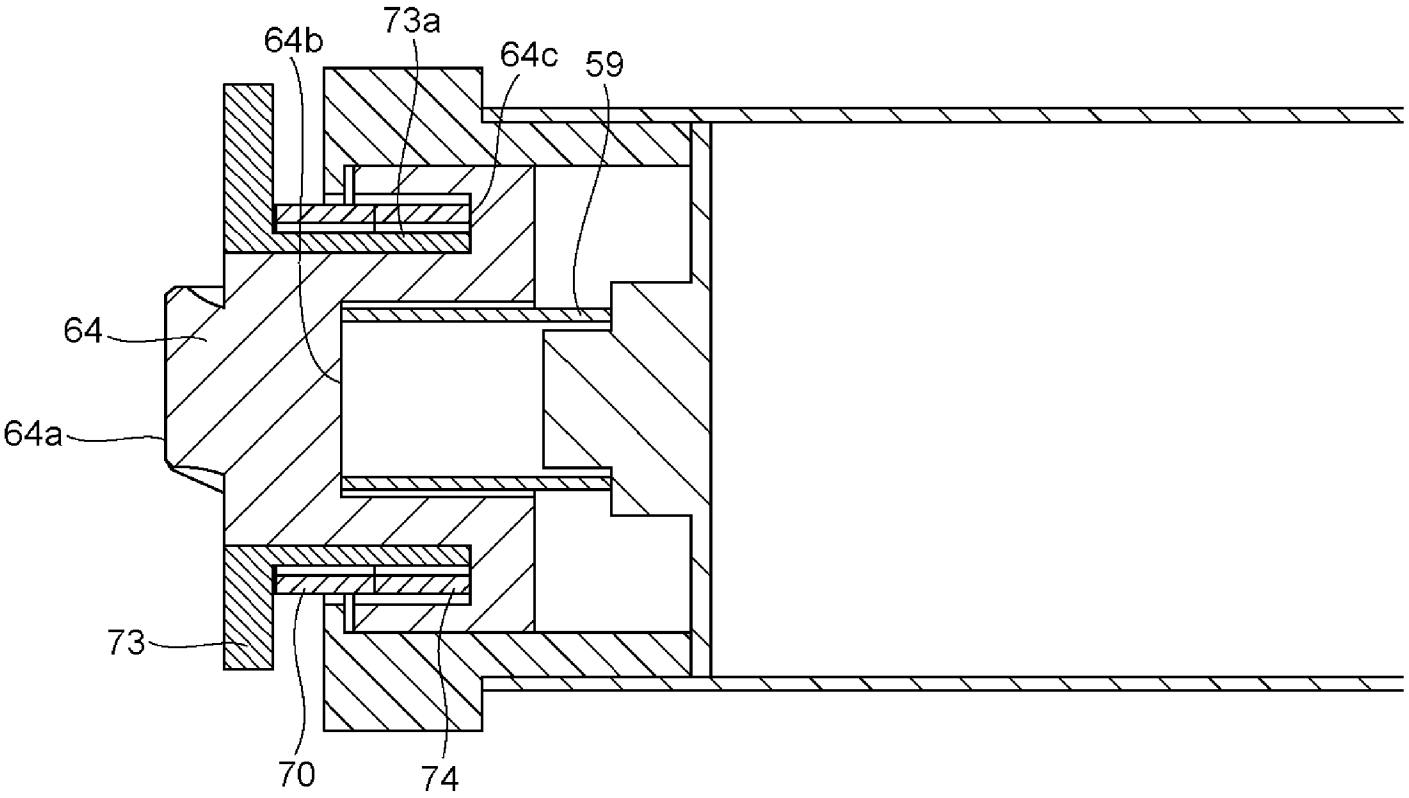

FIG. 11 is a longitudinal partial sectional view of the drive side end of the drum unit.

Figure 12:
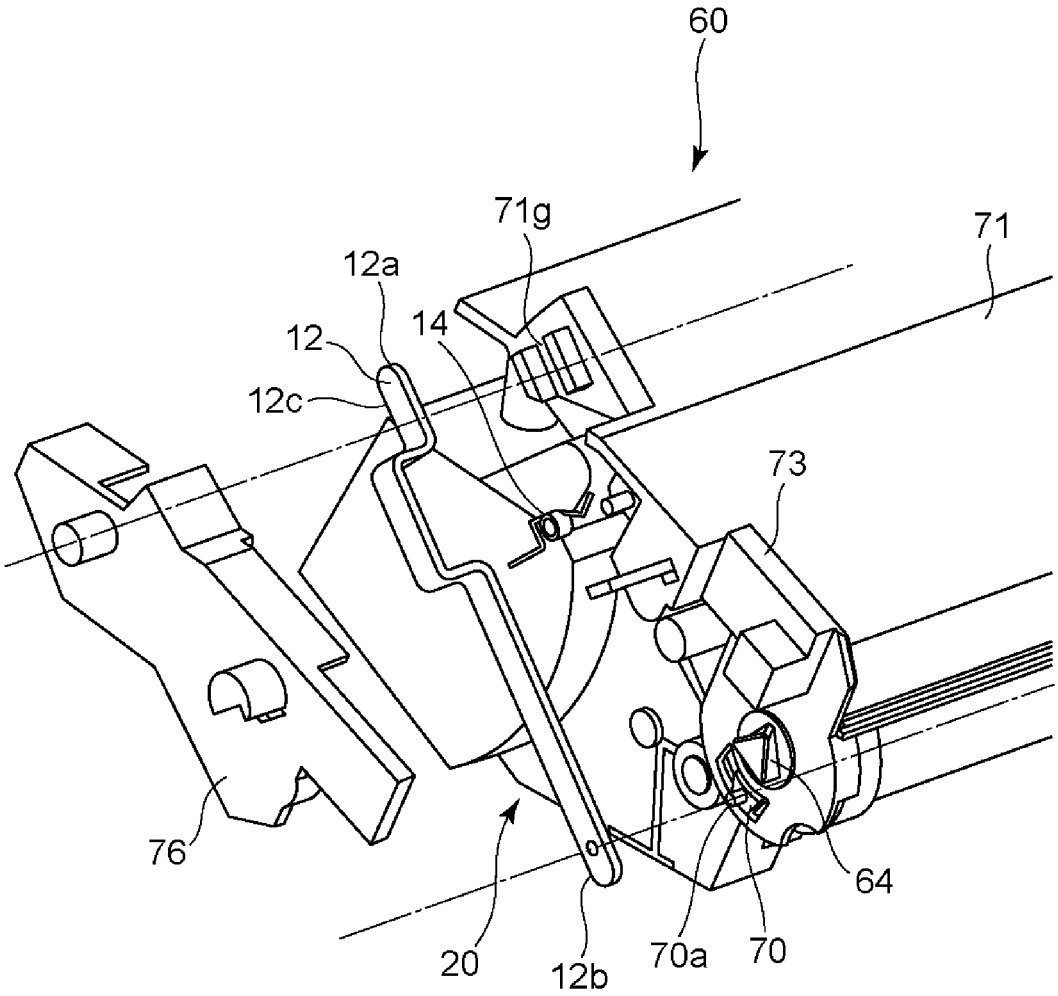

FIG. 12 is a partial perspective view of a cleaning unit including an operating unit.

Figure 13:
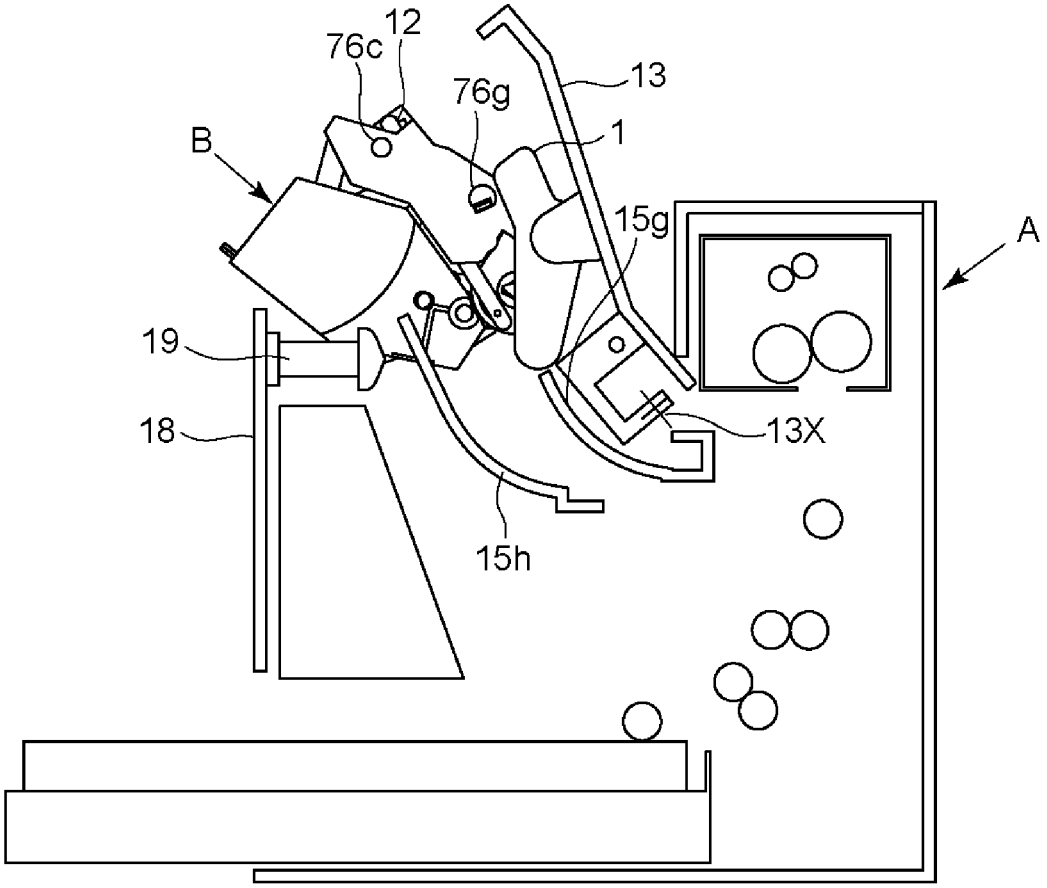

FIG. 13 is a sectional view of the image forming apparatus in a state before the opening/closing door of the apparatus main assembly is opened and the process cartridge is mounted to the apparatus main assembly.

Figure 14:
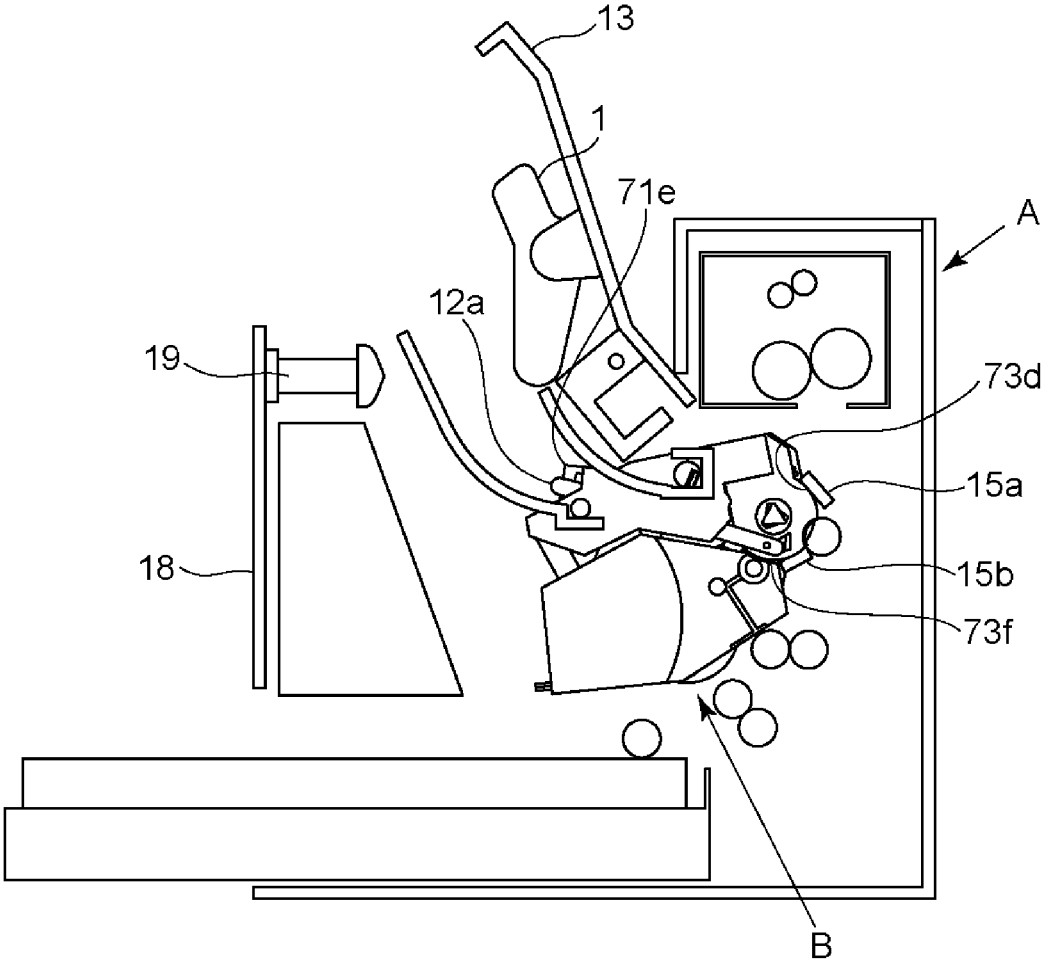

FIG. 14 is a cross-sectional view of the image forming apparatus in a state where the mounting of the process cartridge in the apparatus main assembly is completed and the opening/closing door is not closed.

Figure 15:
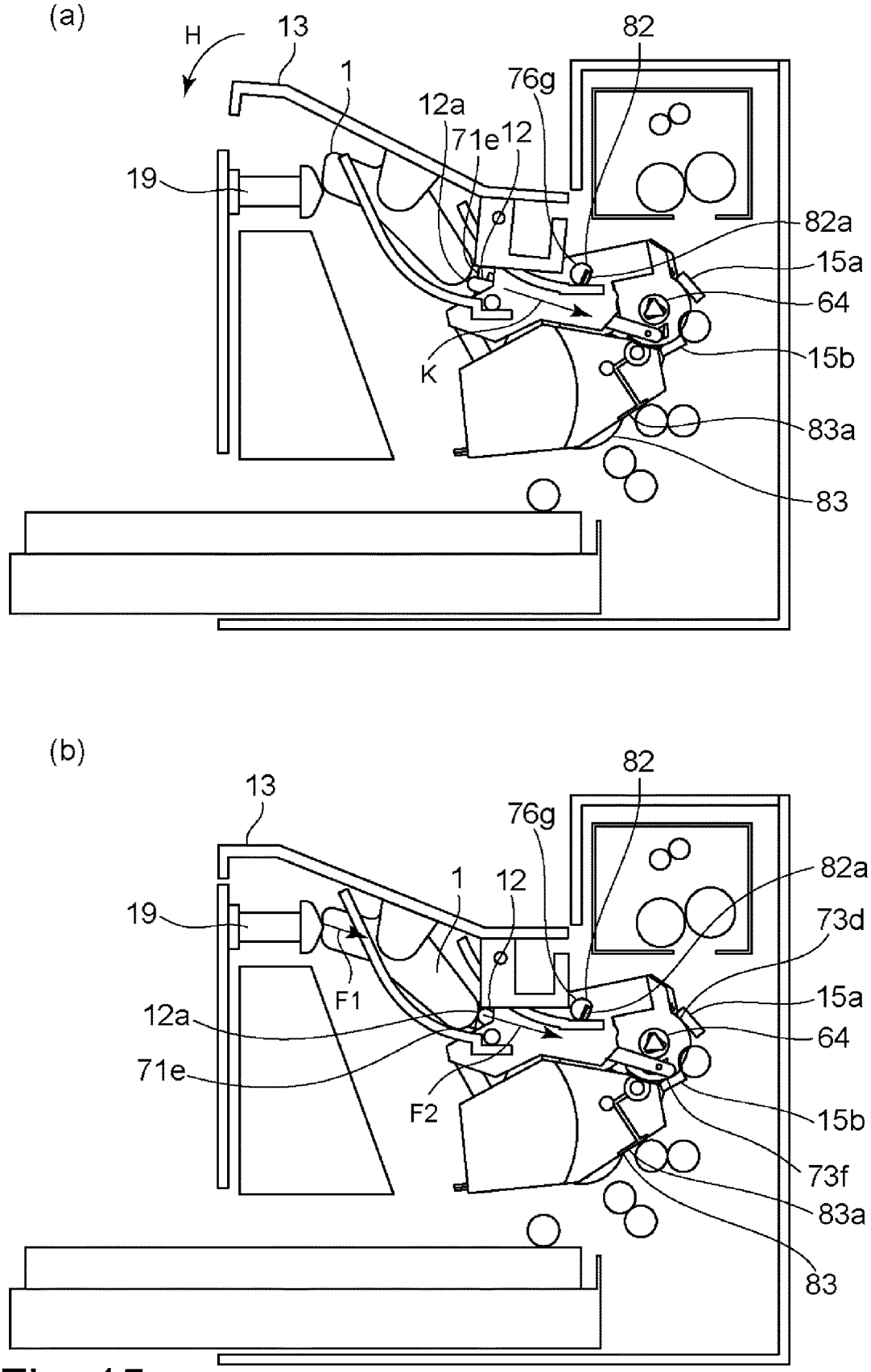

FIG. 15 is a sectional view of the image forming apparatus illustrating the process in which a cartridge pressing member contacts a lever member in this embodiment.

Figure 16:
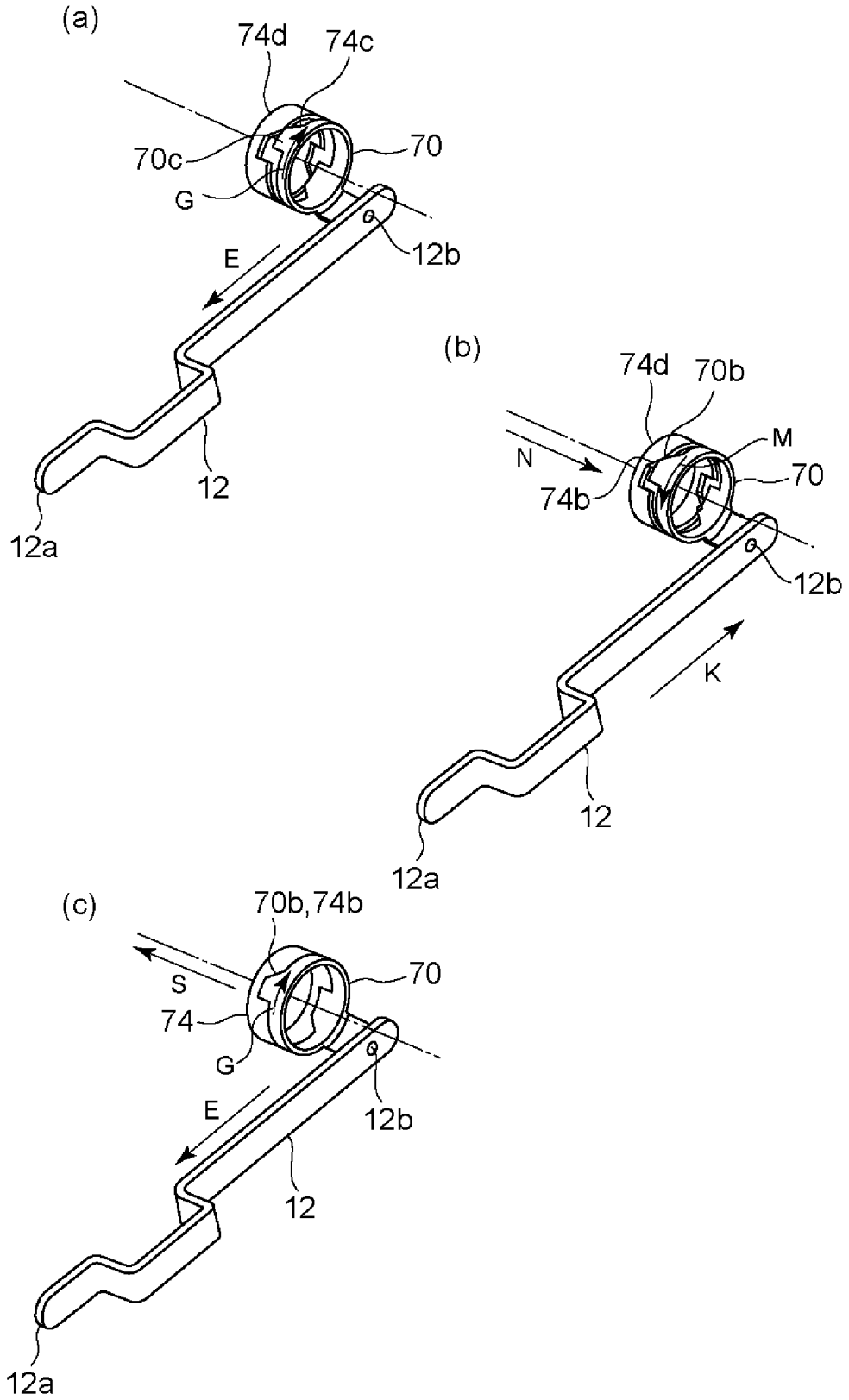

FIG. 16 is a perspective view of an outer cylindrical cam member, an inner cylindrical cam member, and the lever member.

Figure 17:
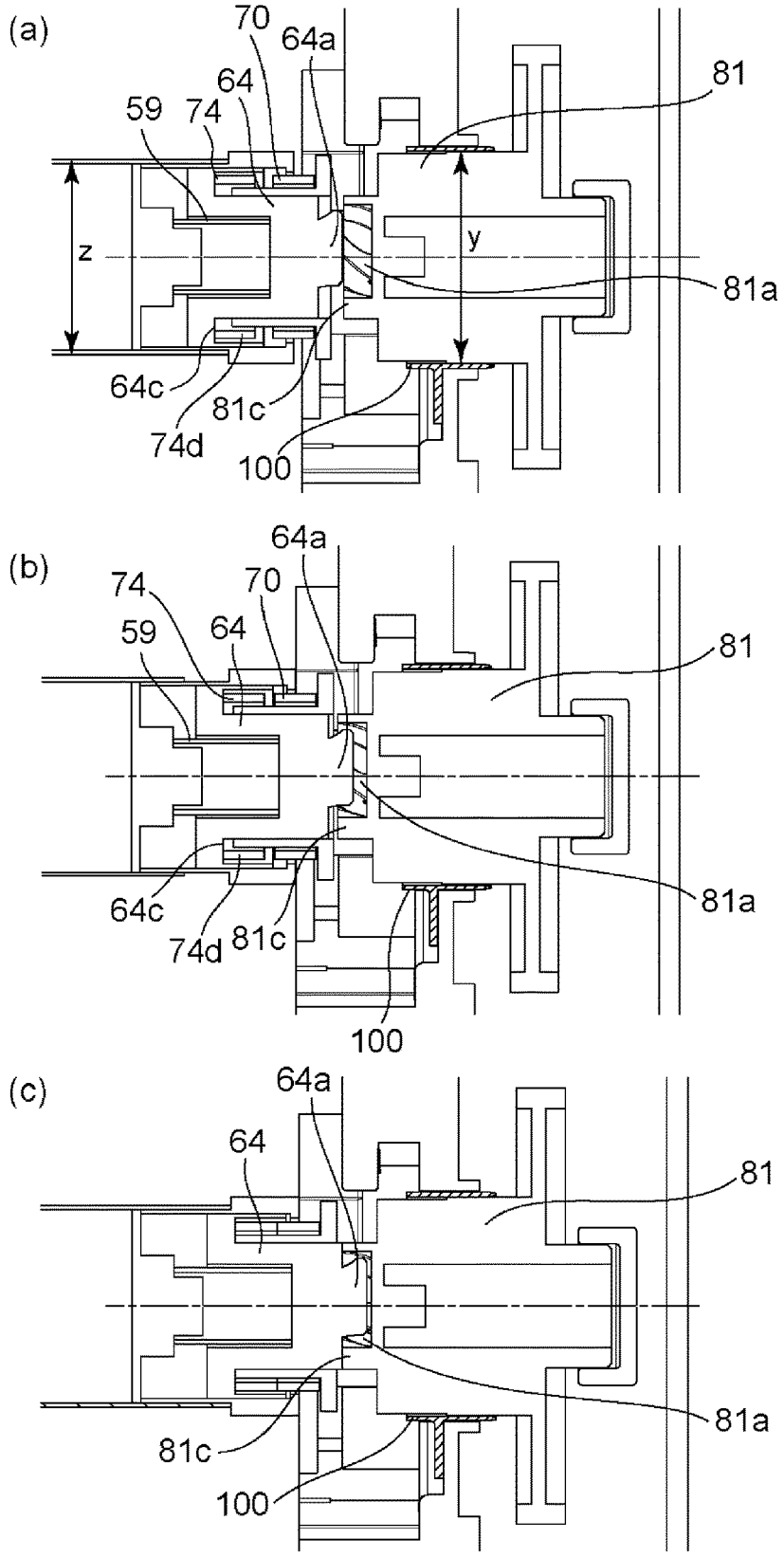

FIG. 17 is a longitudinal sectional view of the drive transmission member and the coupling member of the apparatus main assembly.

Figure 18:
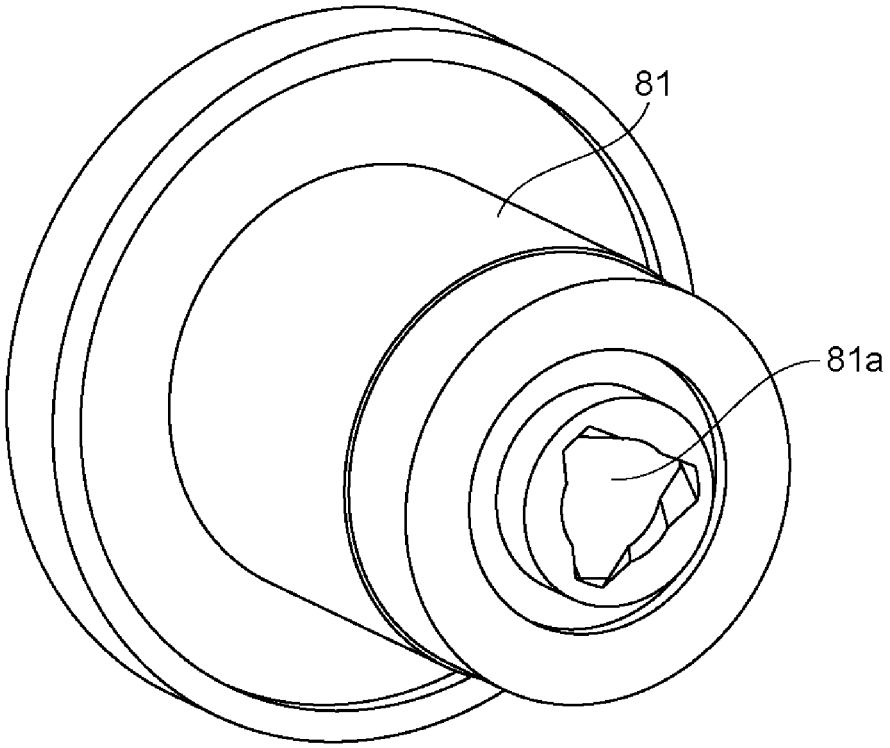

FIG. 18 is a perspective view of the main assembly drive transmission member.

Figure 19:
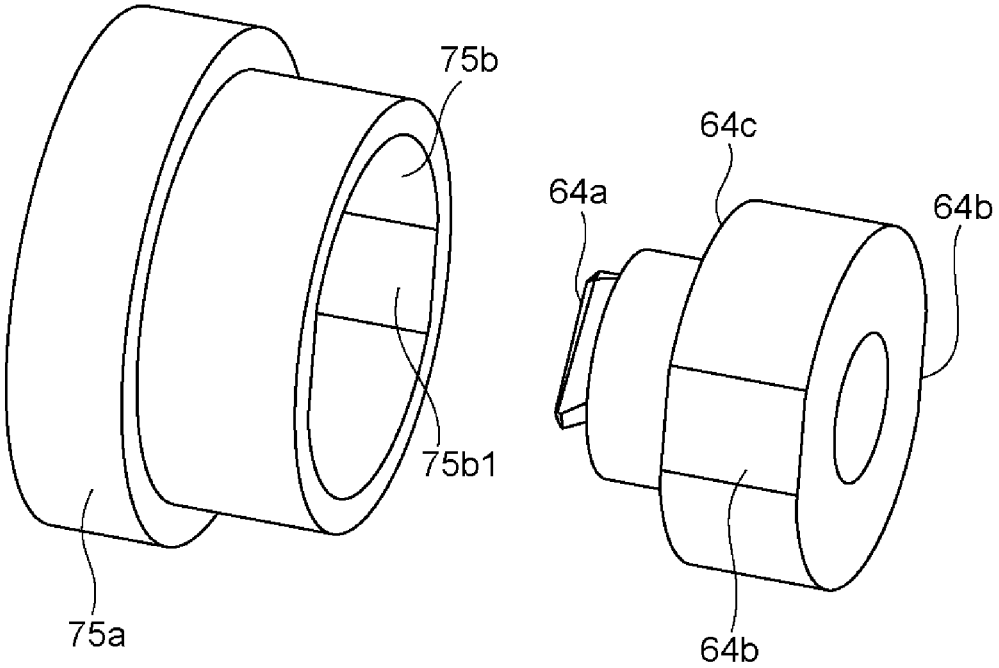

FIG. 19 is an illustration of a connecting structure between the coupling member and the driving side flange member.

Figure 20:
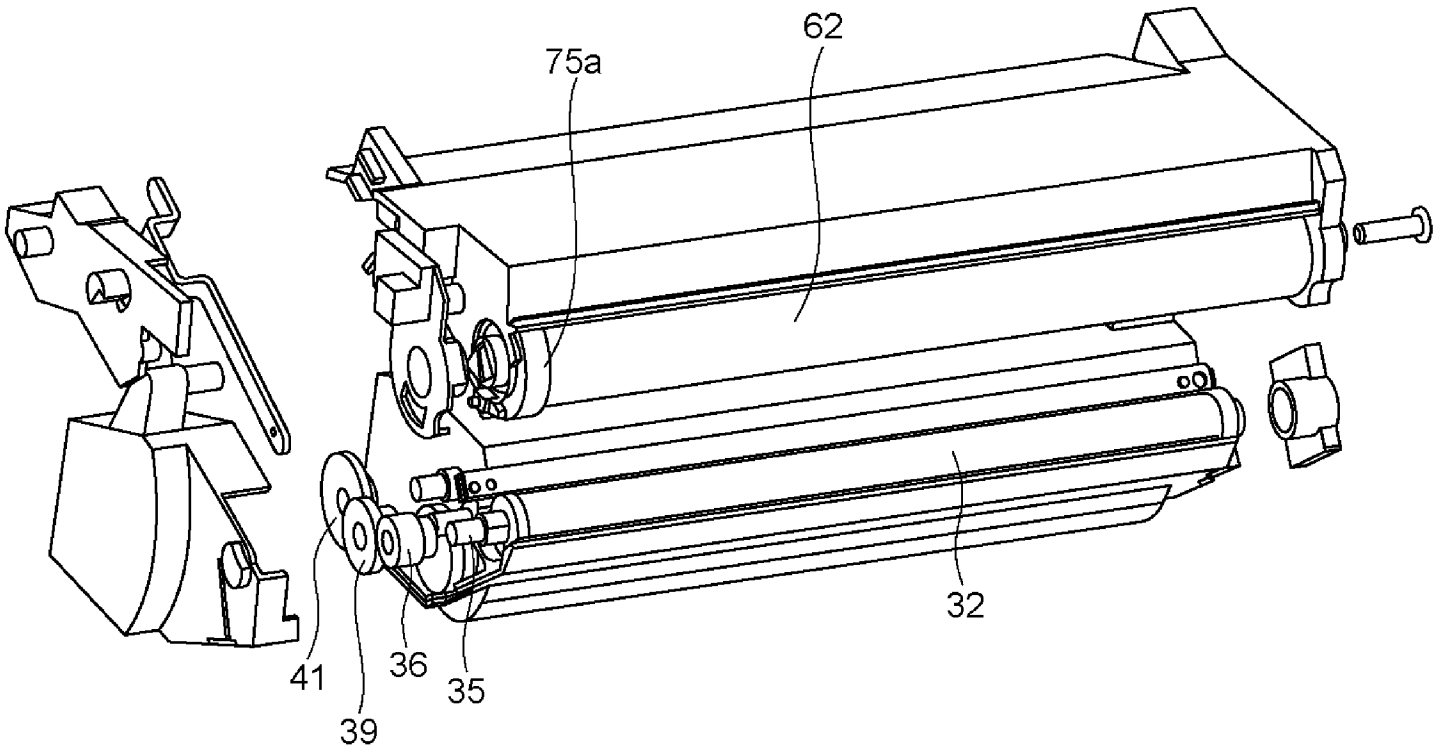

FIG. 20 is an exploded perspective view of the cartridge.

Figure 21:
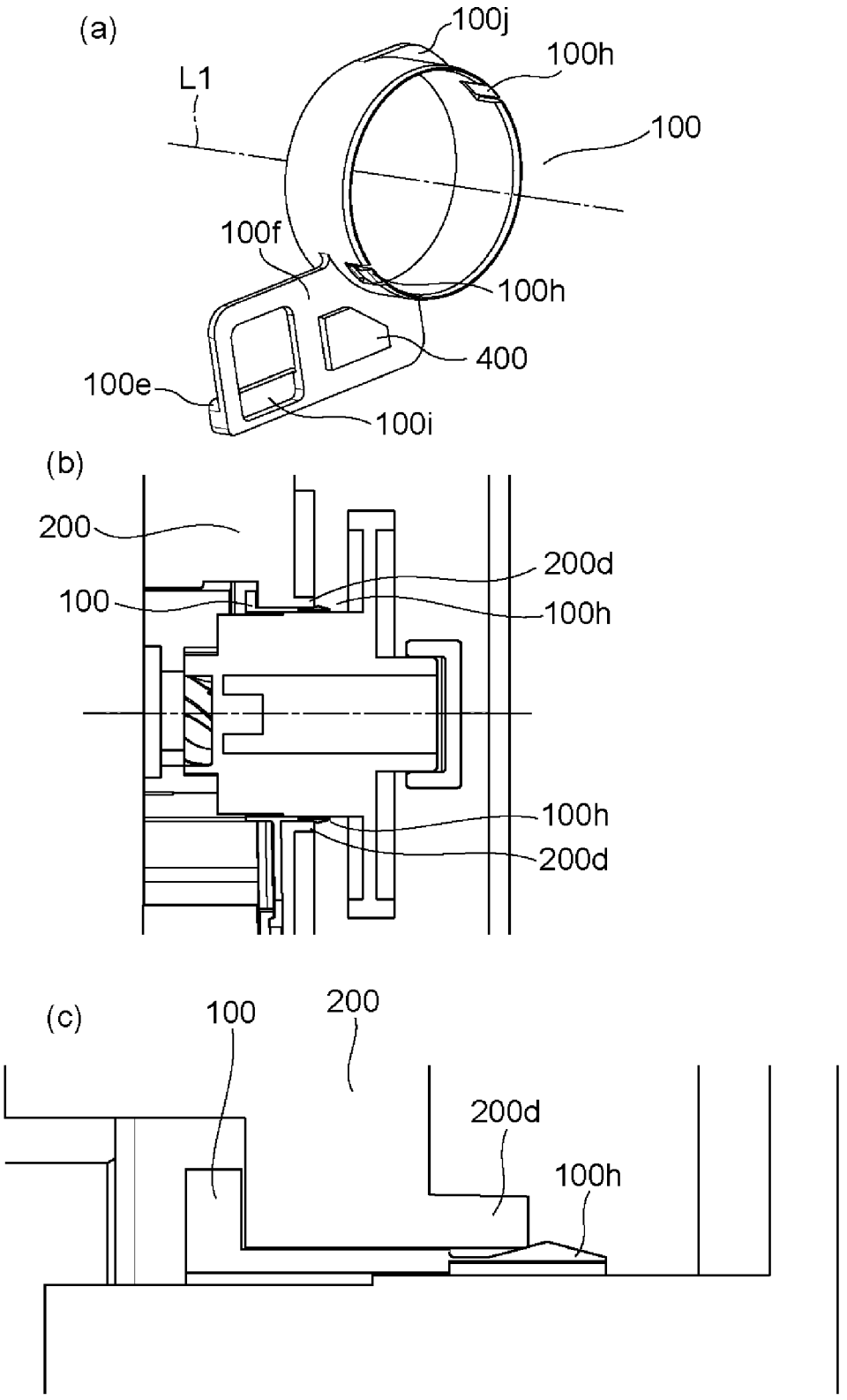

In FIG. 21, part (a) is a perspective view of the attachment, part (b) is a cross-sectional view of the apparatus main body and the attachment, and part (c) is an enlarged cross-sectional view of a longitudinal retaining portion of the attachment.

Figure 22:
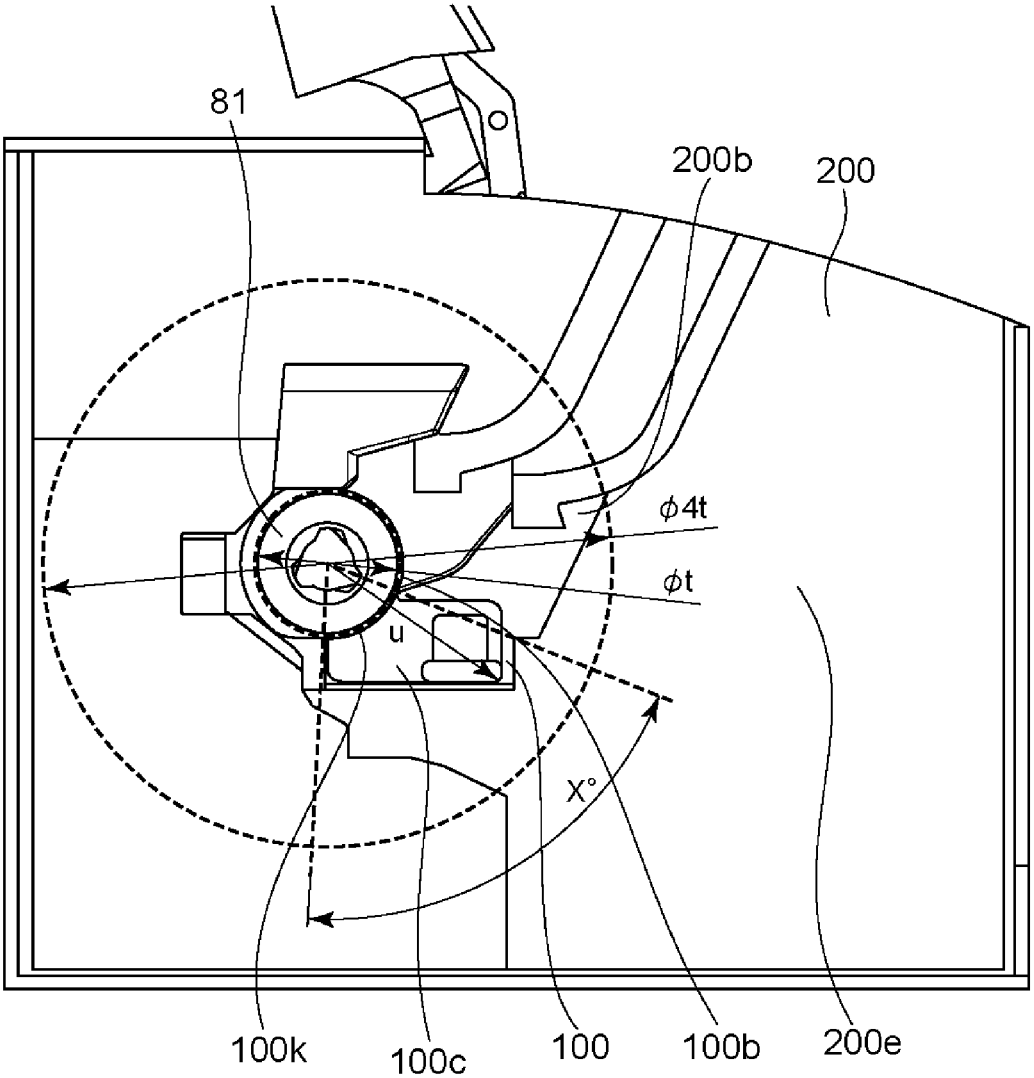

FIG. 22 is a perspective view of the apparatus main assembly and the attachment.

Figure 23:
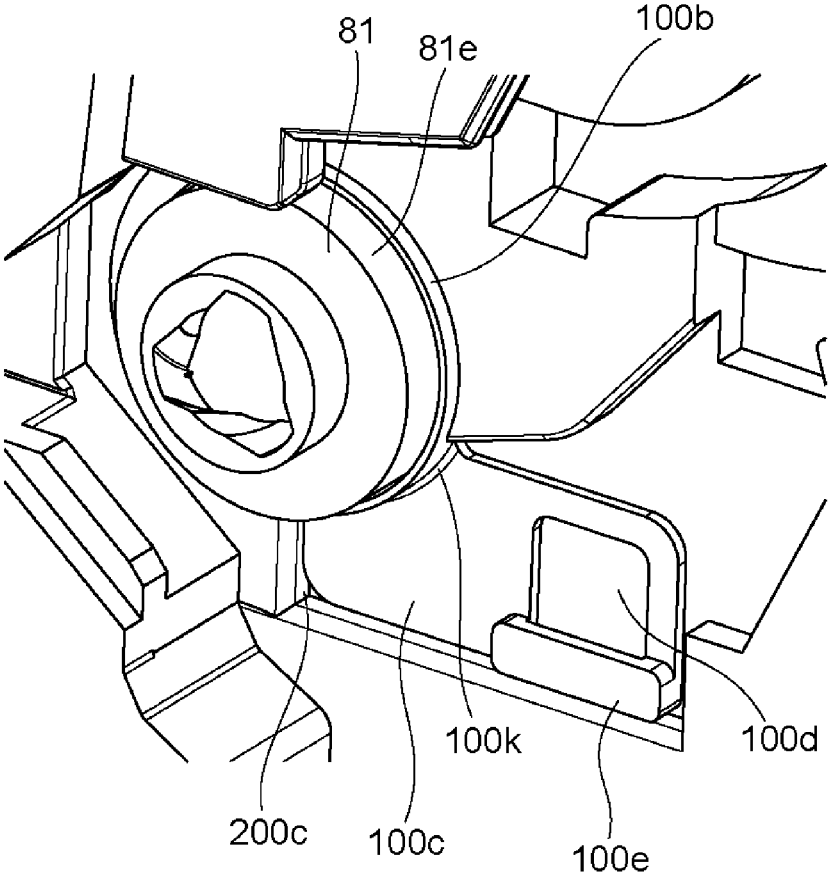

FIG. 23 is an enlarged perspective view of the apparatus main assembly and the attachment.

Figure 24:
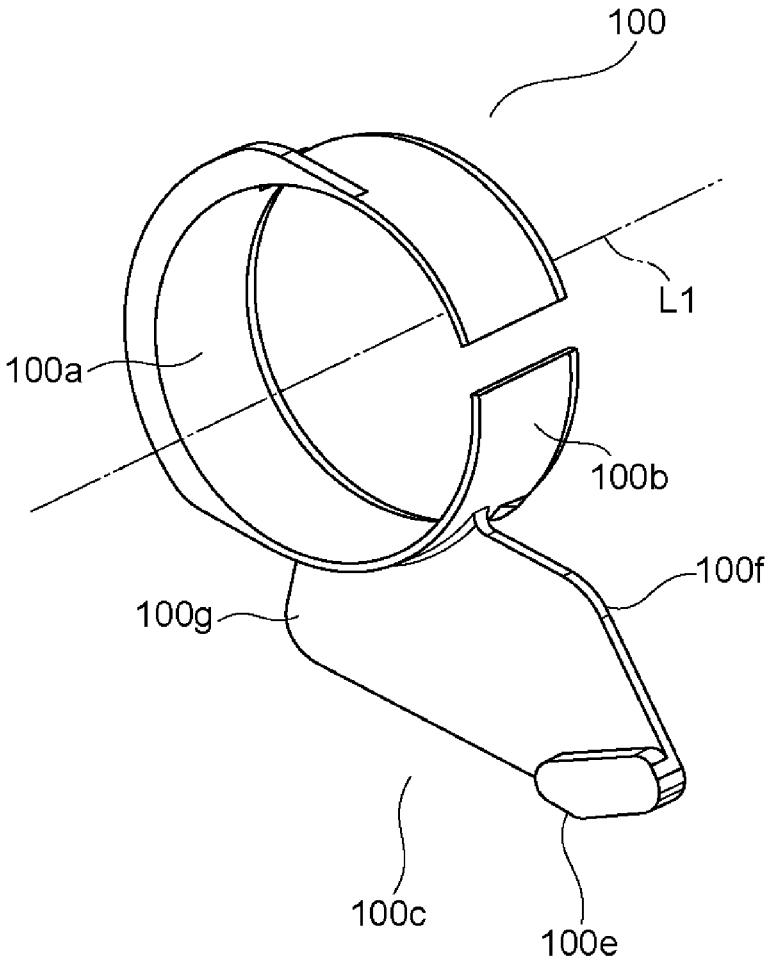

FIG. 24 illustrates a second modification of the attachment.

Figure 25:
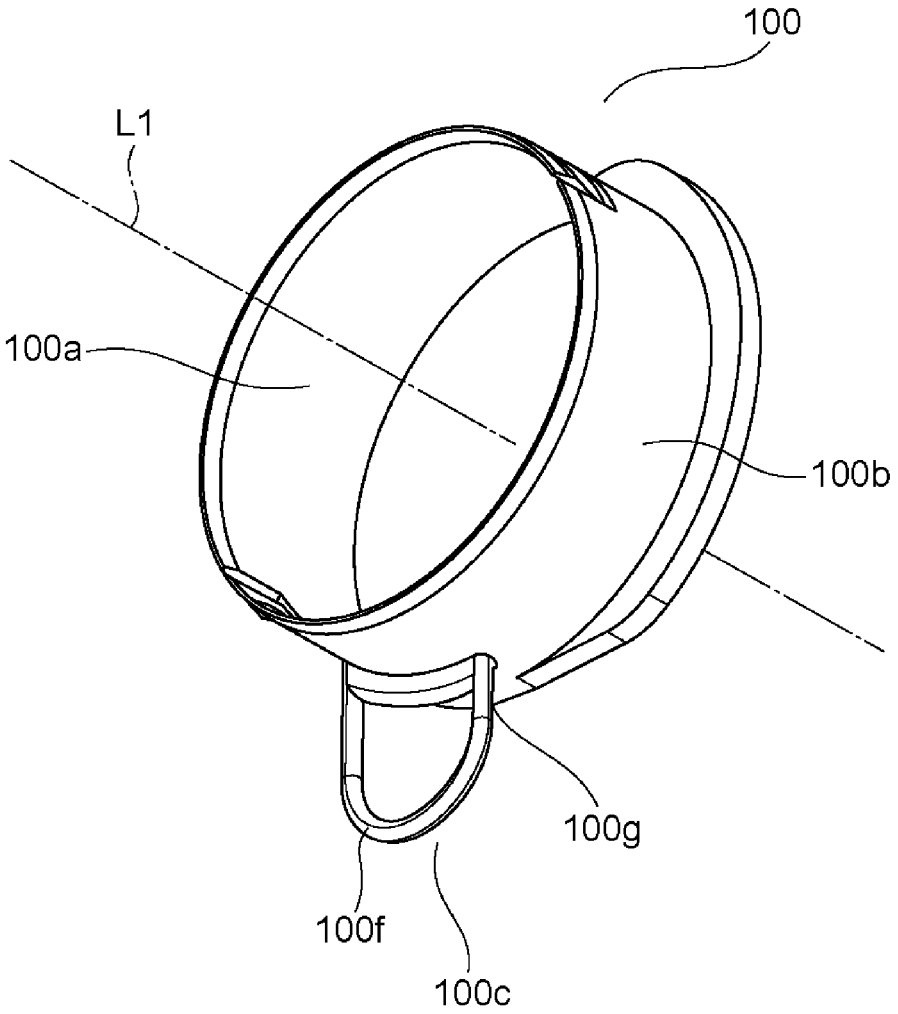

FIG. 25 illustrates a third modification of the attachment.

Figure 26:
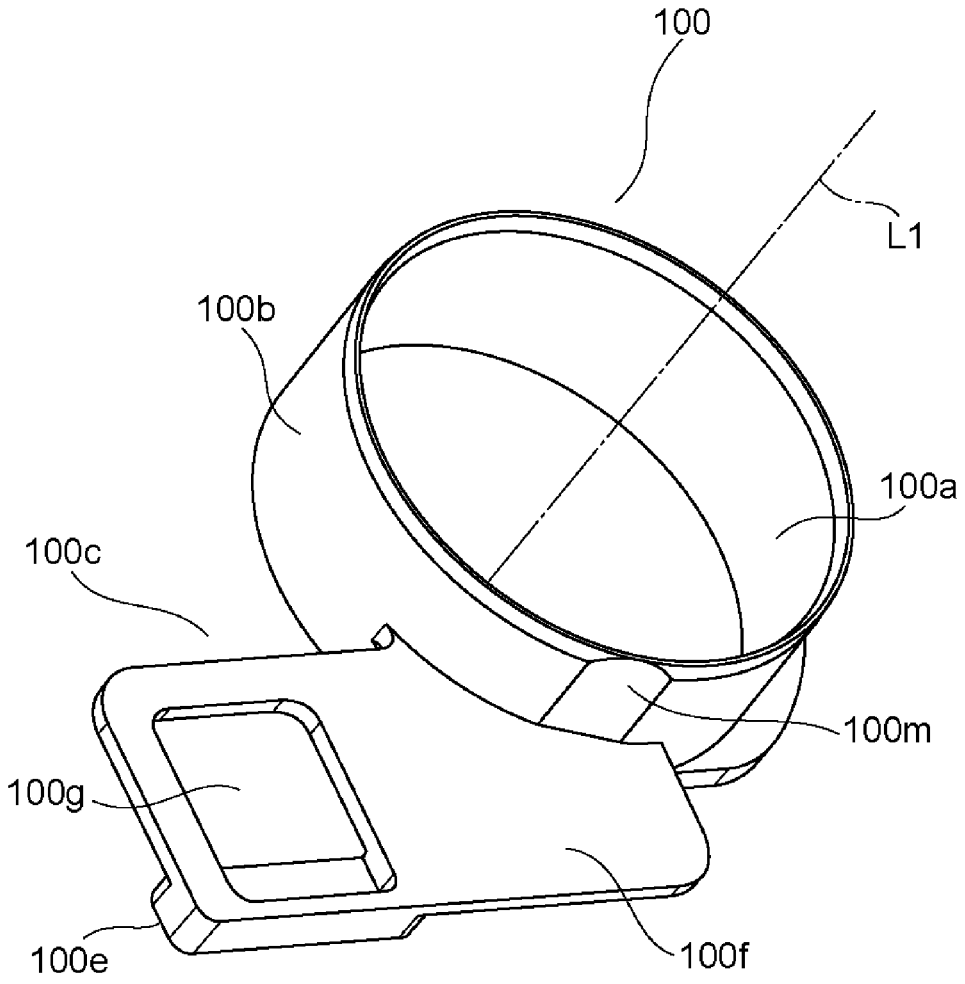

FIG. 26 is a perspective view of the attachment.

DESCRIPTION OF THE EMBODIMENT

Embodiment 1

Hereinafter, Embodiment 1 will be described in detail with reference to the accompanying drawings.

Unless otherwise specified, the rotation axis direction of the electrophotographic photosensitive drum is simply referred to as the longitudinal direction.

Further, in the longitudinal direction, the side where an electrophotographic photosensitive drum receives the driving force from the image forming apparatus main assembly is a driving side, and the opposite side is a non-driving side.

Figure 2:
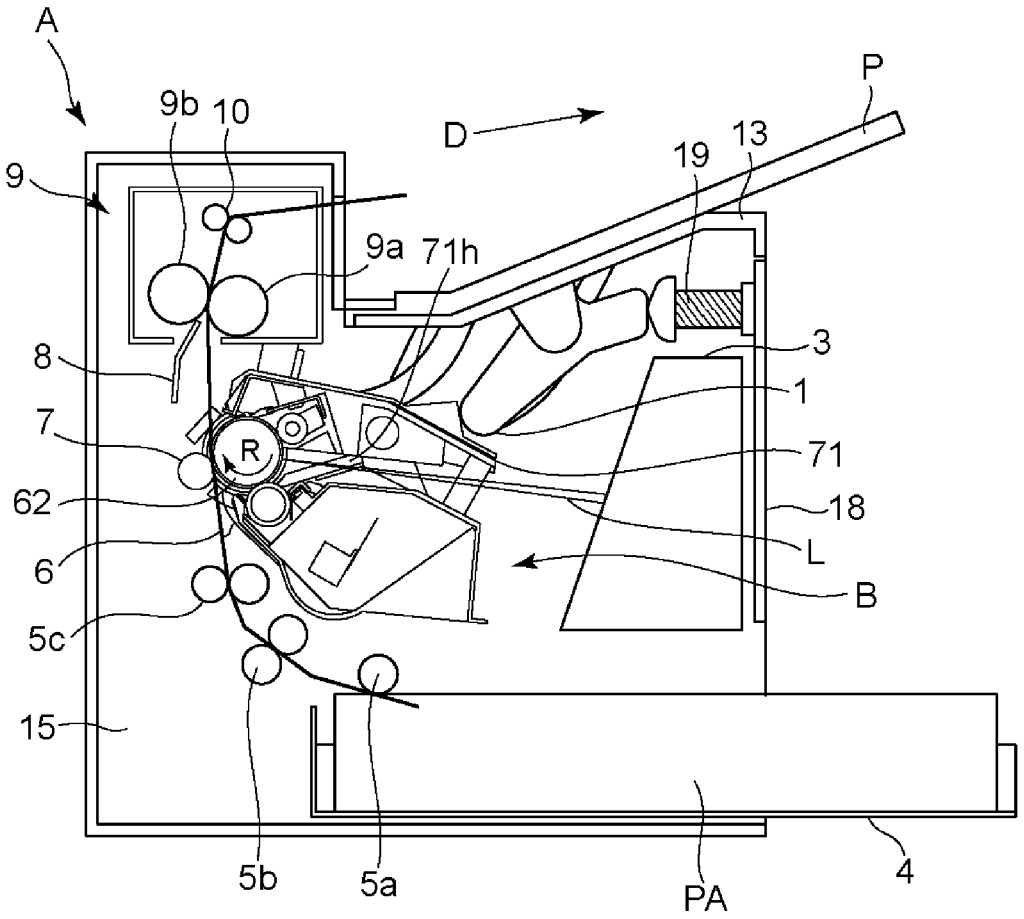
FIG. 2 is a cross-sectional view of a main assembly of an image forming apparatus and the process cartridge.
Figure 3:
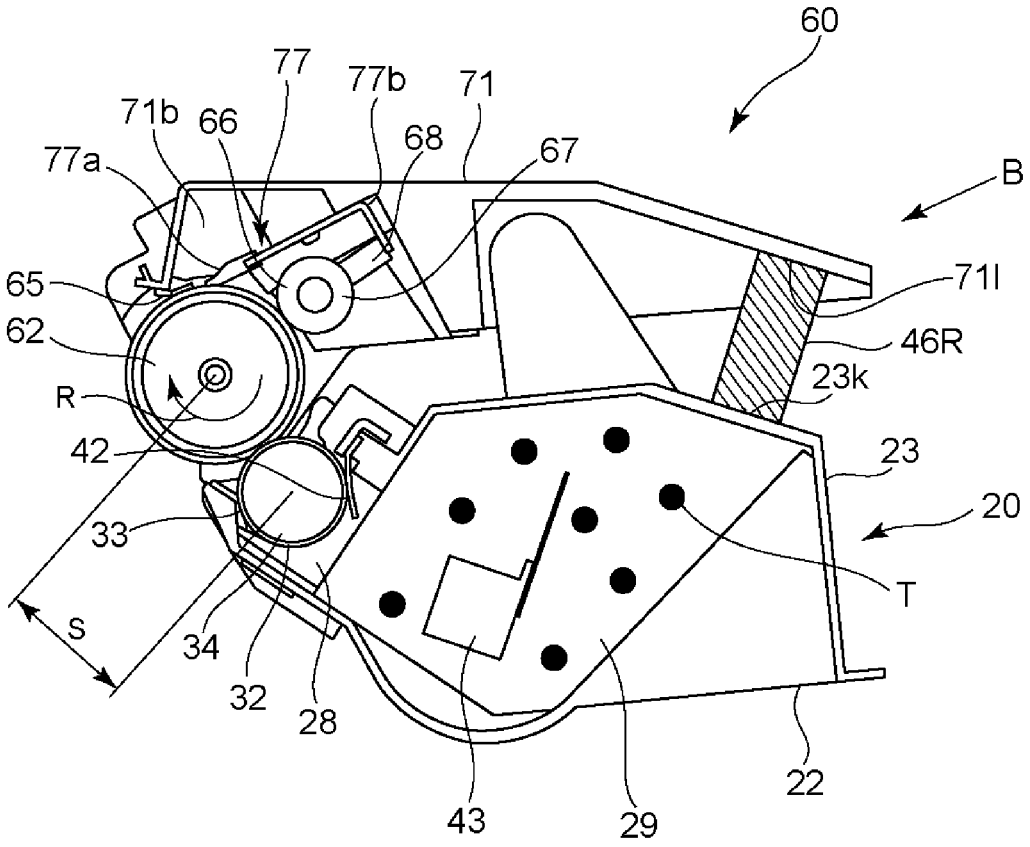
FIG. 3 is a sectional view of the process cartridge.

Referring to FIGS. 2 and 3, the overall structure and image forming process will be described.

FIG. 2 is a cross-sectional view of an apparatus main assembly (electrophotographic image forming apparatus main assembly, image forming apparatus main assembly) A and a process cartridge (hereinafter, referred to as a cartridge B) of the electrophotographic image forming apparatus.

FIG. 3 is a sectional view of the cartridge B.

Here, the apparatus main assembly A is a portion of the electrophotographic image forming apparatus, excluding the cartridge B. The cartridge B is mountable to and dismountable from the apparatus main assembly A.

<Overall Structure of Electrophotographic Image Forming Apparatus>

The electrophotographic image forming apparatus (image forming apparatus) shown in FIG. 2 is a laser beam printer using an electrophotographic technique in which the cartridge B is dismountably mounted to the apparatus main assembly A. When the cartridge B is mounted to the apparatus main assembly A, the exposure device 3 (laser scanner unit) for forming a latent image on an electrophotographic photosensitive drum 62 as an image bearing member of the cartridge B is provided. Is In addition, below the cartridge B, a sheet tray 4 accommodating recording materials to be subjected to the image forming operation (hereinafter referred to as sheet materials PA) is provided. The electrophotographic photosensitive drum 62 is a photosensitive member (electrophotographic photosensitive member) used for electrophotographic image formation.

In addition, in the main assembly A of the apparatus, along the conveyance direction D of the sheet material PA, there are provided a pickup roller 5*a*, a feeding roller pair 5*b*, a conveyance roller pair 5*c*, a transfer guide 6, a transfer roller 7, a conveyance guide 8, a fixing device 9, a discharge roller pair 10 and a discharge tray 11 in the order named. The fixing device 9 comprises a heating roller 9*a* and a pressure roller 9*b*.

<Image Forming Process>

Next, the outline of the image forming process will be described. In response to the print start signal, the electrophotographic photosensitive drum (hereinafter, referred to as photosensitive drum 62 or simply drum 62) is rotationally driven in the direction of arrow R at a predetermined peripheral speed (process speed).

A charging roller (charging member) 66 supplied with a bias voltage is applied contacts an outer peripheral surface of the drum 62 and uniformly charges the outer peripheral surface of the drum 62. The charging roller 66 is a rotatable member (roller) capable of rotating in contact with the drum 62. The charging member is not limited to such a member having a rotatable contact type roller structure, but a charging member (charging device) fixed with a space from the drum 62, such as a corotron* charging device, may be used.

The exposure device 3 outputs a laser beam L in accordance with image information. The laser beam L passes through a laser opening 71*h* provided in a cleaning frame 71 of the cartridge B to scan and expose the outer peripheral surface of the drum 62. By this, an electrostatic latent image corresponding to the image information is formed on the outer peripheral surface of the drum 62.

On the other hand, as shown in FIG. 3, in the developing unit 20 as the developing device, the toner T in a toner chamber 29 is stirred and fed by rotation of a feeding member (stirring member) 43, and fed to the toner supply chamber 28.

The toner T is carried on a surface of a developing roller 32 by a magnetic force of a magnet roller 34 (fixed magnet). The developing roller 32 is a developer carrying member which carries a developer (toner T) to develop the latent image (electrostatic latent image) formed on the drum 62. In this embodiment, a non-contact developing method is used with which a latent image is developed with a small gap between the surfaces of the developing roller 32 and the drum 62. It is also possible to employ a contact developing system in which the latent image is developed while the developing roller 32 is in contact with the drum 62.

The toner T is triboelectrically charged by a developing blade 42, and a toner layer thickness on the peripheral surface of the developing roller 32 as a developer carrying member is regulated.

The toner T is supplied to the drum 62 in accordance with the electrostatic latent image to develop the latent image. By this, the latent image is visualized into a toner image. The drum 62 is an image bearing member which carries the latent image or the visualized image (toner image, developer image) formed with toner (developer image) on the surface thereof.

In addition, the drum 62 and the developing roller 32 are rotatable members (rotating members) which can rotate while carrying a developer (toner) on the surface thereof.

As shown in FIG. 2, the sheet material PA stored in the lower portion of the apparatus main assembly A from the sheet tray 4 is picked up by the pickup roller 5*a*, and fed out by the feeding roller pair 5*b*, and the feeding roller pair 5*c* in timed relation with the output timing of the laser beam L. Then, the sheet material PA is fed to the transfer position formed between the drum 62 and the transfer roller 7 by way of the transfer guide 6. At this transfer position, the toner image is sequentially transferred from the drum 62 to the sheet material PA.

The sheet material PA now having the toner image transferred is separated from the drum 62 and fed to the fixing device 9 along a conveyance guide 8. Then, the sheet material PA passes through a nip portion between the heating roller 9*a* and the pressure roller 9*b* which form the fixing device 9. Pressure and heat fixing processing is effected in this nip portion, so that the toner image is fixed on the sheet material PA. The sheet material PA which has been subjected to the toner image fixing process is fed to the discharge roller pair 10 and is discharged to the discharge tray 11.

On the other hand, as shown in FIG. 3, residual toner on the outer peripheral surface of the drum 62 after the image transfer is removed by a cleaning blade 77, and is used again in the image forming process. The toner removed from the drum 62 is stored in a waste toner chamber 71*b* of a toner cleaning unit 60. The cleaning unit 60 is a unit including a photosensitive drum 62.

In the above description, the charging roller 66, the developing roller 32, the transfer roller 7, and the cleaning blade 77 are process means (process members, acting members) that act on the drum 62.

<Structure of Entire Cartridge>

Figure 4:
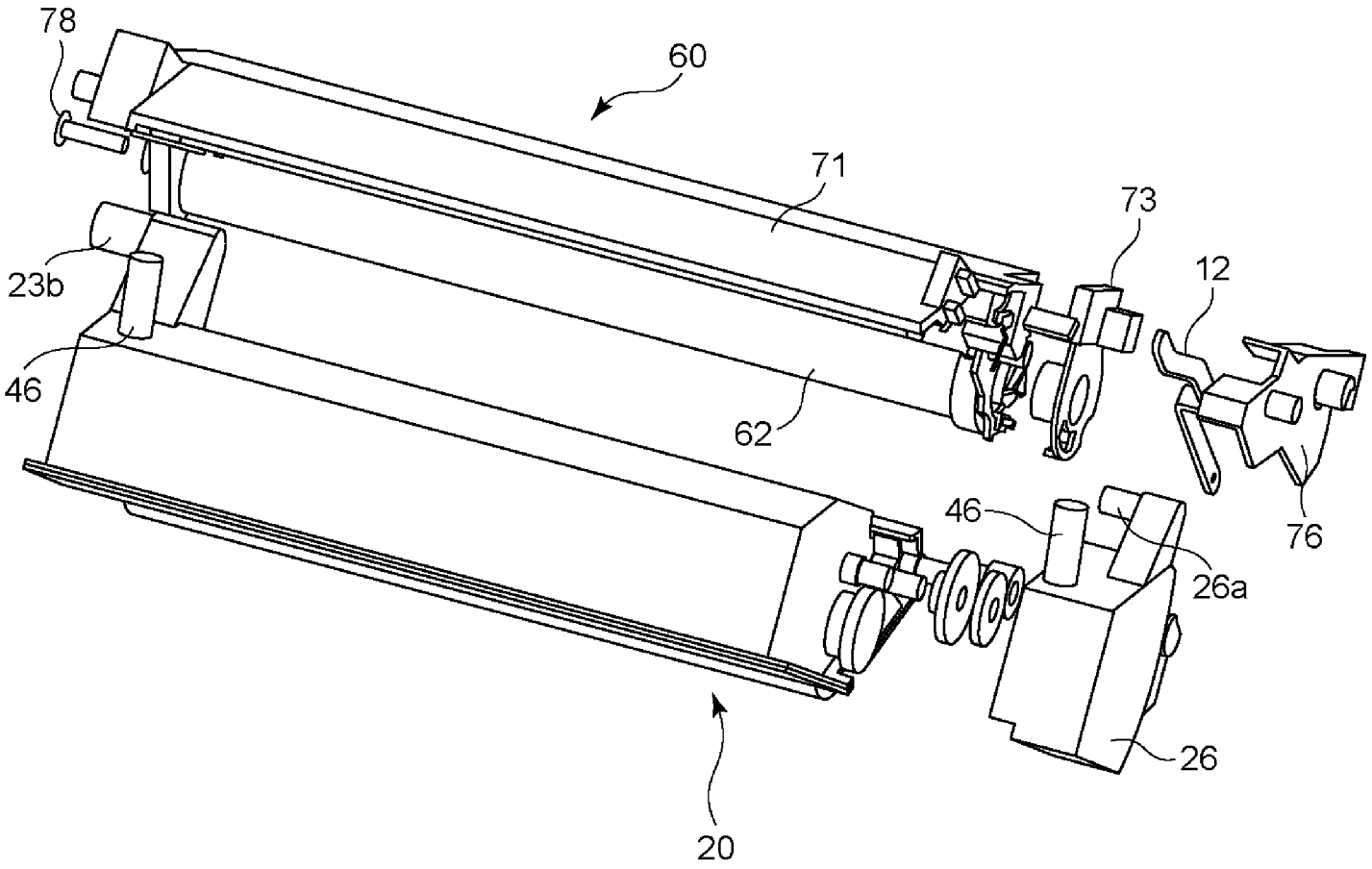
FIG. 4 is a perspective view of the apparatus main assembly and the process cartridge with an opening/closing door opened.
Figure 5:
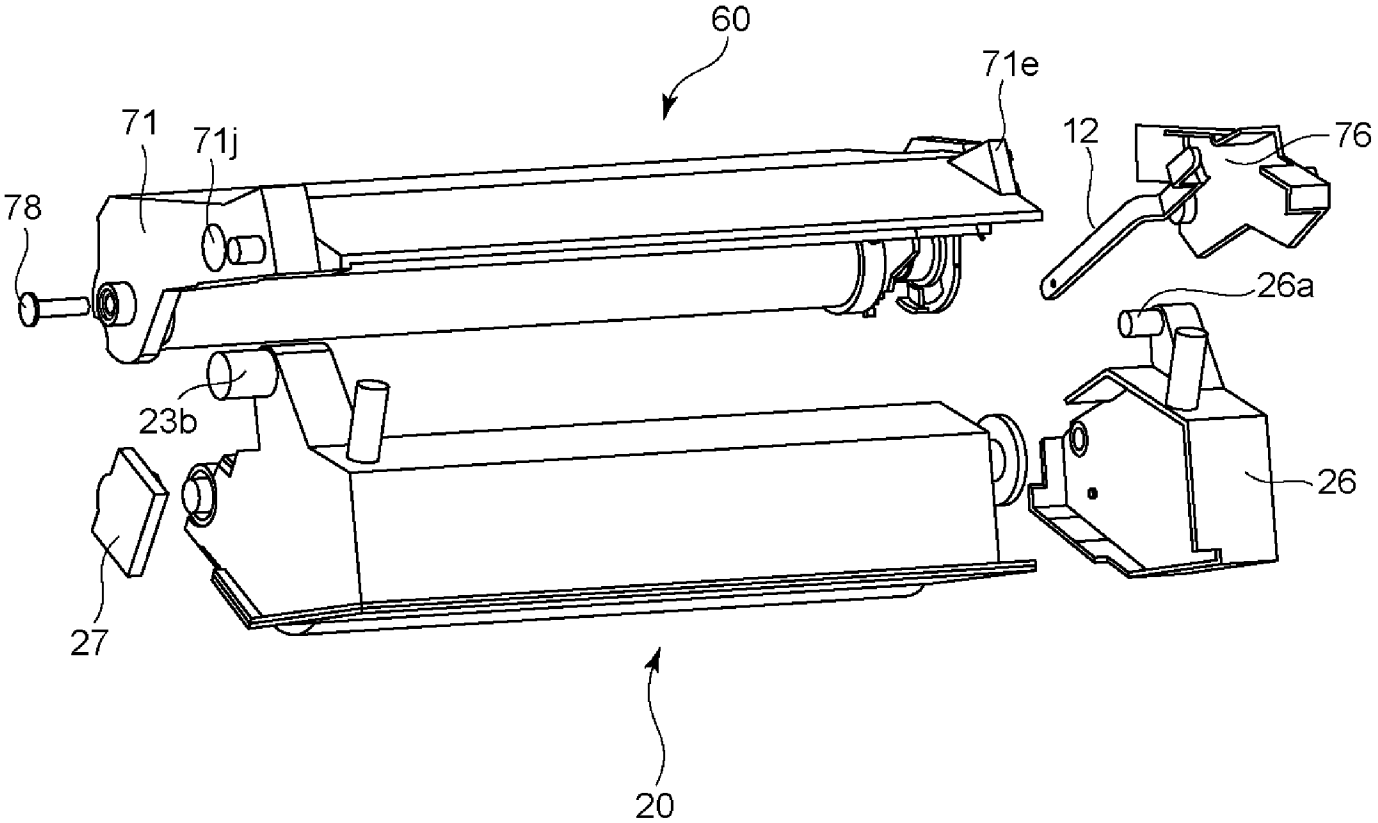
FIG. 5 is a perspective view of the process cartridge.

Referring to FIGS. 3, 4 and 5, the overall structure of the cartridge B will be described. FIG. 3 is a sectional view of the cartridge B, and FIGS. 4 and 5 are perspective views illustrating the structure of the cartridge B. In this embodiment, description will be made while omitting screws for connecting the parts.

The description of an operating unit including a lever member will be made later, and the description thereof is omitted here.

The cartridge B includes the cleaning unit.

As shown in FIG. 3, the cleaning unit 60 includes a drum 62, a charging roller 66, a cleaning member 77, and a cleaning frame 71 which supports them. On the drive side of the drum 62, a drive side drum flange 63 provided on the drive side is rotatably supported by a hole 73*a* of a drum bearing 73. In a broad sense, the drum bearing 73, the side member 76, and the cleaning frame 71 can be collectively referred to as a cleaning frame.

On the non-driving side, as shown in FIG. 5, the hole (not shown) of the non-driving side drum flange is rotatably supported by the drum shaft 78 press-fitted into the hole provided in the cleaning frame 71.

In the cleaning unit 60, the charging roller 66 and the cleaning member 77 are provided in contact with the outer peripheral surface of the drum 62.

The cleaning member 77 includes a rubber blade 77*a* which is a blade-shaped elastic member formed of rubber as an elastic material, and a support member 77*b* which supports the rubber blade. The rubber blade 77*a* is in contact with the drum 62 in the counter direction with respect to the rotational direction of the drum 62. That is, the rubber blade 77*a* is in contact with the drum 62 so that the free end surface thereof faces an upstream side in the rotational direction of the drum 62.

As shown in FIG. 3, the waste toner removed from the surface of the drum 62 by the cleaning member 77 is stored in the waste toner chamber 71*b* formed by the cleaning frame 71 and the cleaning member 77.

In addition, as shown in FIG. 3, a scooping sheet 65 for preventing the waste toner from leaking from the cleaning frame 71 is provided at an edge portion of the cleaning frame 71 so as to contact the drum 62.

The charging roller 66 is rotatably mounted to the cleaning unit 60 by way of charging roller bearings (not shown) at the opposite ends in the longitudinal direction of the cleaning frame 71.

The longitudinal direction of the cleaning frame 71 (longitudinal direction of the cartridge B) is substantially parallel with the direction in which the rotation axis of the drum 62 extends (axial direction). Hereinafter, unless otherwise specified, the longitudinal direction or the axial direction is intended to mean the axial direction of the drum 62.

The charging roller 66 is pressed against the drum 62 by urging the charging roller bearing 67 toward the drum 62 by the urging member 68. The charging roller 66 is rotated by the rotation of the drum 62.

As shown in FIG. 3, the developing unit 20 includes a developing roller 32, a developing container 23 which supports the developing roller 32, a developing blade 42, and the like. The developing roller 32 is rotatably mounted to the developing container 23 by bearing members 27 (FIG. 5) and bearing members 37 (FIG. 4) provided at the opposite ends.

The magnet roller 34 is provided inside the developing roller 32. In the developing unit 20, the developing blade 42 for regulating the toner layer on the developing roller 32 is provided. As shown in FIGS. 4 and 5, a spacing member 38 is mounted to each of the opposite ends of the developing roller 32, and the spacing member 38 and the drum 62 are in contact to each other, so that a small gap is maintained between the surfaces of the developing roller 32 and the drum 62. In addition, as shown in FIG. 3, a blow-out prevention sheet 33 for preventing the toner from leaking from the developing unit 20 is provided at an edge of a bottom member 22 so as to contact the developing roller 32. Further, a feeding member 43 is provided in a toner chamber 29 formed by the developing container 23 and the bottom member 22. The feeding member 43 stirs the toner contained in the toner chamber 29 and transports the toner to the toner supply chamber 28.

As shown in FIGS. 4 and 5, the cartridge B is structured by combining the cleaning unit 60 and the developing unit 20.

When connecting the developing unit and the cleaning unit with each other, the center of the first development supporting boss 26*a* of the developing container 23 with respect to the first driving-side hanging hole 71*i* of the cleaning frame 71, and the center of the second development supporting boss 23*b* with respect to the second non-driving-side hanging hole 71*j* are first aligned with each other. Specifically, by moving the developing unit 20 the first development supporting boss 26*a* and the second development supporting boss 23*b* are fitted into the first hanging hole 71*i* and the second hanging hole 71*j*. By this, the developing unit 20 is movably connected to the cleaning unit 60. More specifically, the developing unit 20 is rotatably (rotatably) connected with the cleaning unit 60. Then, the side member 76 is assembled to the cleaning unit 60 to form the cartridge B.

In this embodiment, the driving side biasing member 46L (FIG. 5) and the non-driving side biasing member 46R (FIG. 4) are formed by compression springs. The developing unit 20 is urged by the cleaning unit 60 by the urging force of these springs, and the developing roller 32 is reliably pressed toward the drum 62. The developing roller 32 is held at a predetermined distance from the drum 62 by the distance holding members 38 mounted to both ends of the developing roller 32.

<Attachment Mounting>

Next, referring to parts (a), (b) and (c) of FIG. 6, parts (a) and (b) of FIG. 7, and parts (a) and (b) of FIG. 8, mounting of the attachment to the apparatus main assembly A will be described. Here, FIG. 6A is a perspective view of the drive side of the apparatus main assembly A. FIG. 6(*b*) and FIG. 6(*c*) are cross-sectional views of the apparatus main assembly A of FIG. 6(*a*) taken along the drive transmission member 81. FIGS. 7(*a*) and 7(*b*) are perspective views of the attachment 100. FIG. 8A is a perspective view before the attachment 100 is mounted to the apparatus main assembly A. FIG. 8B is a perspective view when the attachment 100 is mounted to the apparatus main assembly A. FIG. 8C is a sectional view of FIG. 8B taken along the drive transmission member 81.

First, the positional relationship of the drive transmission member (drive output member) 81 with respect to the drive-side guide frame 8200 of the apparatus main assembly A and the method of supporting the drive transmission member 81 by the drive transmission member bearing 300 will be described.

The drive transmission member 81 is a member (driving shaft, apparatus main assembly side coupling member) for transmitting the driving force to the cartridge B by being connected to the cartridge B.

As shown in FIG. 6A, a drive transmission member hole 200*a* is provided in the guide frame 8200, and the drive transmission member 81 is placed in the drive transmission member hole 200*a*. As shown in FIG. 6B, the drive transmission member 81 is supported by the drive transmission member bearing 300 at the end portion in the axial direction. At this time, the outer peripheral surface 81*e* of the drive transmission member 81 forms a gap M between itself and the drive transmission member hole 200*a*. Actually, as shown in FIG. 6C, the drive transmission member 81 is inclined (tilted) by the amount through which it can move in the gap M, due to its own weight or the like.

If the drive transmission member 81 is inclined, it may be difficult to connect the drive transmission member 81 to the cartridge B depending on the structure of the cartridge B. Therefore, in this embodiment, the attachment 100 is mounted to the drive transmission member 81 to suppress the inclination of the drive transmission member 81. Although the details will be described hereinafter, the attachment 100 suppresses the inclination of the drive transmission member 81 by filling the gap M.

As shown in FIGS. 7A and 7B, the main assembly of the attachment 100 is a cylindrical portion having a cylindrical shape. The cylindrical portion (cylindrical shape) has an inner peripheral surface 100*a* and an outer peripheral surface 100*b*. A grip portion 100*c* is provided so as to project from the outer surface 100*b* in a direction intersecting with the axis L1 of the cylinder portion (outside in a radial direction of the cylinder portion). The grip portion 100*c* is provided with a through hole 100*d* and a projection 100*e*. The grip portion 100*c* projects in a direction substantially perpendicular to the axis L1. The axis L1 is an imaginary line extending through the center of the cylindrical portion.

The inside of the cylindrical portion (cylindrical shape) of the attachment 100 is a space, and opposite ends in the axial direction of the cylindrical shape are open. That is, the inner space of the cylindrical shape can be accessed from both ends of the cylinder.

Next, a mounting process of the attachment 100 to the apparatus main assembly A will be described. As shown in FIGS. 8A and 8C, by inserting a finger into the through hole 100*d* provided in the grip portion 100*c* and by griping the projection 100*e* with the finger, the attachment 100 can be inserted into the gap M is formed between the drive transmission member 81 and the drive transmission member hole 200*a*. By placing the attachment 100 around the drive transmission member 81, the inclination of the drive transmission member 81 is suppressed (the inclination angle becomes smaller).

The projection 100*e* is a protrusion (projection) provided so that the user can easily grip the grip 100*c*. Similarly, the through hole 100*d* is also an opening (space) provided so that the user can easily grip the grip portion 100*c*. Both the projection 100*e* and the opening (the through hole 100*d*) are not necessarily required for the grip 100*c*. For example, even if there is provided one of them, it is effective to facilitate the user's gripping the grip portion 100*c*. Further, in this embodiment, the opening provided in the grip portion 100*c* is the hole 100*d* surrounded by the grip portion 100*c* all around, but the opening is not limited to such a shape, and other shapes are usable as long as it is a space into which the user can insert his/her finger.

Next, a mounting completion position of the attachment 100 relative to the apparatus main body A will be described. As shown in FIG. 8C, the position of the attachment 100 in the longitudinal direction (axial direction) with respect to the apparatus main assembly A can be determined by a longitudinal regulation portion (position regulation portion) 100*f*. The longitudinal regulation surface 200*b* of the guide frame R200 and the longitudinal regulation portion 100*f* provided on the holding portion 100*c* of the attachment are brought into contact with each other. By this, the position of the attachment 100 can be determined, and the attachment 100 can be prevented from entering the back of the guide frame R200. The longitudinal direction of the attachment 100 is the axial direction of the cylindrical portion of the attachment 100 (direction parallel to the axis L1).

Further, the outer peripheral surface 81*e* of the drive transmission member 81 and the inner peripheral surface 100*a* of the attachment 100 are in contact with each other. Therefore, as shown in FIGS. 8B and 8C, when the drive transmission member 81 is rotated by the drive motor (not shown) of the main assembly, the attachment 100 tends to rotate about the axis of the drive transmission member 81. However, the rotation of the attachment 100 can be restricted (suppressed) by the rotation restricted surface 200*c* of the guide frame R200 and the rotation restricting portion 100*g* provided on the grip 100*c* of the attachment 100 contacting each other.

<Advancing/Retreating Mechanism of Coupling Member>

The description will be made as to that coupling member 64 and the advancing/retreating mechanism portion for advancing/retreating the coupling member. The coupling member 64 is a member (drive input member, input coupling) for receiving the driving force (rotational force) for rotating the drum 62 and the developing roller 32 from the outside of the cartridge (that is, the image forming apparatus main assembly).

FIG. 18 is a perspective view of the drive transmission member (drive output member) 81. As shown in this Figure, the drive transmission member 81 is provided with a recess (drive transmission portion 81*a*) having a substantially triangular shape. The driven transmission portion 64*a* of the coupling member 64 is engaged with the recess (drive transmission portion 81*a*), so that the coupling member 64 receives the driving force. Referring to FIG. 12, the drive side flange unit 69 will be described.

The drive side flange unit 69 in this embodiment includes the coupling member 64, a drive side flange member 75, a lid member 58, and a first pressing member 59. The coupling member 64 includes the driven transmission portion (driving force receiving portion) 64*a* and the driving transmission portion 64*b*. The driving force is transmitted from the drive transmission member (drive output member) 81 (FIGS. 17 and 18) of the apparatus main assembly A to the driven transmission portion 64*a*. The drive transmitting portion 64*b* is supported by the drive side flange member 75 and at the same time transmits drive to the drive side flange member 75.

The drive side flange member 75 comprises a gear portion 75*a* which transmits the drive to a gear member 36 (FIG. 20) provided at the end portion of the developing roller, a coupling support portion 75*b* (FIG. 19), and the like. After the coupling member 64 is inserted to the inner periphery (coupling support portion 75*b*) of the driving side flange member 75, the first pressing member 59 for urging the coupling member 64 toward the driving side is inserted. Thereafter the, the lid member 58 is fixed to the end portion 75*c* of the driving side flange member 75 by means such as welding, so that the driving side flange unit 69 is structured.

FIG. 19 is a perspective view of the driving side flange member 75 and the coupling member 64. A The inner peripheral surface of the driving side flange member 75 functions as a coupling support portion 75*b*. The drive-side flange member 75 supports the coupling member 64 by supporting the outer peripheral surface of the coupling member 64 on the inner peripheral surface (coupling support portion 75*b*). In addition, of the outer peripheral surface of the coupling member 64, two surfaces symmetrically arranged with respect to the rotation axis are flat portions. This flat surface portion functions as the drive transmission portion 64*b* of the coupling member 64. The inner peripheral surface 75*b* of the flange member 75 is also provided with two flat surface portions 75*b*1 corresponding to the drive transmission portion 64*b*. The flat surface portion of the flange member 75 functions as the driven transmission portion 75*b*1 of the flange member 75. That is, the driving force is transmitted from the coupling member 64 to the flange member 75 by the drive transmission portion 64*b* of the coupling member 64 contacting the transmitted portion 75*b*1 of the flange member 75.

The drive side flange 75 of the drive side flange unit 69 is fixed to the end portion of the photosensitive drum 62 by means such as press fitting or clamping (FIG. 11). By this, the driving force (rotational force) received by the coupling member 64 from the drive transmission member 81 (FIGS. 17 and 18) is transmitted to the photosensitive drum 62 by way of the drive side flange 75.

Next, FIG. 20 is an exploded perspective view of the cartridge. As shown in FIG. 20, the driving force (rotational force) is transmitted from the driving side flange 75 also to the developing roller 32 by way of the gear 75*a*. That is, the gear 75*a* is in meshing engagement with the developing roller gear 36 to transmit the rotation of the driving side flange 75 to the developing roller gear 36. The developing roller gear 36 is provided on the developing roller 32, and more specifically, is engaged with a shaft portion of a developing roller flange 35 fixed to the end portion of the developing roller 32. Therefore, the rotation of the developing roller gear 36 is transmitted to the developing roller 32 by way of the developing roller flange 35. Further, the developing roller gear 36 also transmits the drive to the feeding member gear 41 by way of the idler gear 39. The feed member gear 41 is provided on the feed member 43 (FIG. 3), and when the feed member gear 41 rotates, the feed member 43 also rotates.

That is, the drive side flange 75 functions as a drive transmission member (cartridge side drive transmission member) for transmitting drive from the coupling member 64 to the drum 62, the developing roller 32, the conveyance member 43, and the like. In this embodiment, the driven transmission portion 64*a* of the coupling member 64 has a projection shape (projected portion) with a substantially triangular cross-section. Specifically, a substantially triangular cross-section twisted counterclockwise about the axis of the photosensitive member drum from the driving side to the non-driving side is employed. However, the shape of the driven transmission portion 64*a* is not limited to such a shape as long as it can engage the driving transmission member 81 (FIG. 18) and can receive a driving force. In this embodiment, the drive transmission member 81 of the apparatus main assembly A is provided with a substantially triangular recess (drive transmission portion 81*a*, FIG. 18)

which can be engaged with the driven transmission portion 64*a*. Therefore, the driven transmission portion 64*a* has a projection shape which engages with the recess portion. The projection shape may be plural rather than singular, and the shape is not limited to the triangle. In addition, although the projection shape has been described as having a twisted triangular shape, it does not necessarily have to be twisted.

As shown in FIG. 17, the coupling member 64 is structured to be movable forward and backward and forth along the longitudinal direction (axial direction). FIG. 17A shows a state in which the coupling member is retracted and disengaged from the drive transmission member 81. In FIG. 17C, the coupling member 64 is advanced and engaged with the drive transmission member 81. It shows a state of match Further, FIG. 17B shows a state (a process of forward/backward movement) between FIGS. 17A and 17C.

Therefore, next, an operating unit (an operating mechanism, an advancing/retreating unit, an advancing/retreating mechanism) that enables such a longitudinal movement of the coupling member 64 will be described referring to FIGS. 10, 11, and 12.

FIG. 10 is a partial perspective view illustrating the structure of the operation unit provided in the cleaning unit 60 according to this embodiment.

FIG. 11 is a partial longitudinal cross-sectional view of the drum unit driving side end portion according to this embodiment.

FIG. 12 is a partial perspective view illustrating the operation unit according to the present embodiment similarly to FIG. 7.

As shown in FIGS. 10 to 12, the operating unit includes an outer cylindrical cam member 70, an inner cylindrical cam member 74, a lever member 12, a second pressing member (elastic member, biasing member) 14, and the like. The operation unit is a control mechanism (control unit) that is connected to the coupling member 64 and controls the movement (advancing/retreating movement) of the coupling member 64.

The outer cylindrical cam member 70 comprises a cylindrical cam portion 70*b* and a lever member engaging portion 70*a* for engaging the lever member 12. Like the outer cylindrical cam member 70, the inner cylindrical cam member 74 contacts the cylindrical cam portion 70*b* and the coupling member 64 to restrict the longitudinal position of the coupling member 64 from the coupling member 64 longitudinal position regulating surface 74*d* and the like.

As shown in FIGS. 10 and 11, in this embodiment, the outer cylindrical cam member 70 and the inner cylindrical cam member 74 are structured to be supported by the outer peripheral portion 73*a* of the drum bearing member 73. The lever member engaging portion 70*a* of the outer cylindrical cam member 70 is structured to be exposed to the outside of the drum bearing member 73 (FIG. 12).

After the developing unit 20 is supported by the cleaning unit 60, the engaged portion 12*b* provided at one end of the lever member 12 is engaged with the lever member engaging portion 70*a* of the outer cylindrical cam member 70. Further, the lever member 12 is arranged such that the slide target portion 12*c* at the other end is positioned between the slide ribs 71*g* provided on the cleaning frame 71. That is, the projection-shaped engaging portion 70*a* enters the inside of the hole-shaped engaged portion 12*b* to engage with each other, so that the lever member 12 is connected to the outer cylindrical cam member 70.

After the lever member 12 is positioned, the second pressing member 14 which presses and urges the lever member 12 is placed between the cleaning frame 71 and the lever member 12. In this embodiment, the torsion coil spring is used as the second pressing member (urging member) 14, but the present invention is not limited to such an example. For example, an elastic member (spring) having a different structure such as a compression coil spring can be preferably used.

By fixing the side member 76 to the cleaning frame 71, a process cartridge including the operation unit according to this embodiment is structured.

This operating unit is connected to the coupling member 64 at the inner cylindrical cam 74, and the coupling member 64 can be moved forward and backward (moved) by operating the lever member 12. Although the detailed operation principle will be described hereinafter, since the lever member 12 is connected to the outer cylindrical cam member 70, the outer cylindrical cam 70 is rotated by the lever member 12 moving in a substantially linear manner. The outer cylindrical cam 70 is in contact with the inner cylindrical cam 74, and the rotational movement of the outer cylindrical cam 70 causes the inner cylindrical cam 74 to move forward and backward in the longitudinal direction. The inner cylindrical cam 74 is in contact with the coupling member 62, and the forward/backward movement of the inner cylindrical cam 74 and the forward/backward movement of the coupling member 62 are interrelated with each other.

That is, the lever member 12 is functionally (indirectly and operatively) connected to the coupling member 64 by way of the outer cylindrical cam member 70 and the inner cylindrical cam member 74, so that the lever member 12 and the coupling member 64 are interrelated with each other.

Referring to Figures' and 13 to 17, the movement of the coupling member 64 to advance and retreat in interrelation with the movement of the lever member 12 will be described. The lever member 12 is structured to move by contact with and separation from a cartridge pressing member (pressing force applying member) provided in the apparatus main assembly A.

Figure 1:
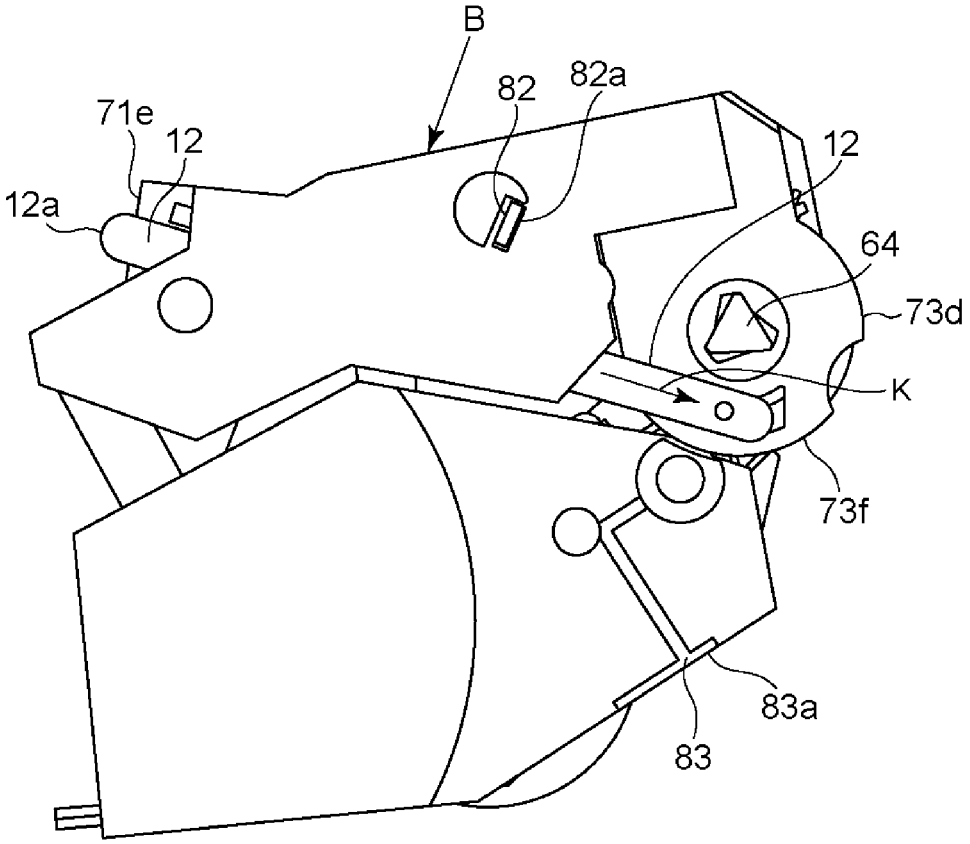
FIG. 1 is a side view of a process cartridge.

FIG. 1 is a side view of a process cartridge B according to this embodiment.

FIG. 13 is a sectional view of the image forming apparatus in a state before the opening/closing door 13 of the apparatus main assembly is opened and the process cartridge B is mounted to the apparatus main assembly A.

FIG. 14 is a cross-sectional view of the image forming apparatus after the mounting of the process cartridge B in the apparatus main assembly A is completed and before the opening/closing door 13 is closed.

FIG. 15A is a cross-sectional view of the image forming apparatus in a state in which the cartridge pressing member 1 starts to contact the pressed portion 12*a* of the lever member 12 in the process of closing the opening/closing door 13 of the apparatus main assembly A in the direction H.

FIG. 15B is a sectional view of the image forming apparatus in which the opening/closing door 13 of the apparatus main assembly A is completely closed.

FIG. 16 is a perspective view of the lever member 12, the outer cylindrical cam member 70, and the inner cylindrical cam member 74 in this embodiment. Here, FIG. 13A is a perspective view in the state (FIG. 13, FIG. 14, FIG. 15A) before the cartridge pressing member 1 contacts the pressed portion 12*a* of the lever member 12. FIG. 16C is a perspective view in the state where the opening/closing door 13 is completely closed and a predetermined pressure of the cartridge pressing spring 19 is applied to the contact portion 12*a* of the lever member 12 (FIG. 15B). FIG. 16B is a perspective view in a state between the states shown in FIGS. 16A and 16C (FIGS. 15A and 15B).

FIG. 17 is a longitudinal sectional view of the drive transmission member 81 and the coupling member 64 of the apparatus main assembly A according to this embodiment, as described above. Similar to FIG. 13, here, FIG. 17A is a longitudinal sectional view of a state (FIGS. 13, 14, and 15A) before the cartridge pressing member contacts the pressed portion 12*a* of the lever member 12. FIG. 17C is a longitudinal sectional view in a state where the opening/closing door 13 is completely closed and a predetermined pressure of the cartridge pressing spring 19 is applied to the contact portion 12*a* of the lever member 12 ((FIG. 15B)). FIG. 14B is a longitudinal sectional view in a state between the states shown in FIGS. 14A and 14C (FIGS. 15A and 15B). As shown in FIG. 13, the process cartridge B is mounted to the apparatus main assembly A after it is opened by rotating the opening/closing door 13 of the apparatus main assembly A about the rotation center 13X. The opening/closing door 13 is an opening/closing member for opening and closing a cartridge mounting portion (space for mounting the cartridge) provided inside the apparatus main assembly A. The mounting portion is provided with guide rails (guide members) 15*h* and 15*g* for guiding the guided portions 76*c* and 76*g* of the process cartridge B, and the cartridge B is mounted to the apparatus main assembly A along the guide rails 15*h* and 15*g* (only the drive side is shown). As shown in FIG. 14, the mounting of the process cartridge B is completed when the positioned portions 73*d* and 73*f* provided on the drum bearing member 73 are brought into contact with the apparatus main assembly positioning portions 15*a* and 15*b* or inserted to the neighborhood thereof.

Two cartridge pressing members 1 are mounted at respective ends of the opening/closing door 13 in the axial direction (FIG. 14). The two cartridge pressing members 1 are movable with respect to the opening/closing door 13 within a certain range.

The two cartridge pressing springs 19 are mounted to respective ends in the longitudinal direction of the front plate 18 provided in the main assembly A of the apparatus. The cleaning frame 71 is provided with the cartridge pressed portions 71*e*, which function as urging force receiving portions of the cartridge pressing spring 19, at respective the longitudinal ends. As will be described hereinafter, when the opening/closing door 13 is completely closed, a predetermined pressure F2 is applied from the cartridge pressing spring 19 to the cartridge pressed portion 71*e* and the lever member pressed portion 12*a*.

Next, the forward/backward movement of the coupling member 64 (driven member) will be described. In the state before the cartridge pressing member 1 abuts the lever member 12 (FIGS. 13, 14, and 15(*a*)), the lever member 12 is urged by the second pressing member 14 (FIG. 12) in the E direction in FIG. 16(*a*).

The outer cylindrical cam member 70, which is engaged with the lever member 12 and is rotatably supported around the drum axis, is urged in the G direction in FIG. 16A. The outermost projecting surface 70*c* of the outer cylindrical cam member 70 contacts the innermost projecting surface 74*c* of the inner cylindrical cam member 74.

As shown in FIG. 17A, the coupling member 64 is urged toward the drive side by the first pressing member 59, and the coupling contact portion 64*c* is pressed against the coupling member longitudinal position restricting surface 74*d* of the inner cylindrical cam member 74. That is, the longitudinal position of the coupling member 64 is also determined depending on the longitudinal position of the inner cylindrical cam member 74 (position in the longitudinal direction). The first pressing member 59 is used to operate the coupling member 64 on the driving side, and therefore, the first pressing member 59 can also be regarded as a portion of the above-described operating unit. In this embodiment, the compression coil spring is used as the first pressing member 59, but it is also possible to urge the coupling member 64 using an elastic member having another shape.

When the cartridge B is not mounted to the apparatus main assembly A, the inner cylindrical cam member 74 retracts the coupling member 64 into the drum against the elastic force of the first pressing member 59. That is, the structure is such that in the state in which the main assembly door 13 is released as shown in FIGS. 13 and 14, or in the state before the cartridge pressing member 1 abuts on the lever member 12, the coupling member 64 is placed at the most non-driving side. The position where the coupling member 64 is retracted to the nondriving side (that is, the inner side of the cartridge B) is referred to as a first position (retracted position, inner position, disengaged position, disengaged position). As shown in FIG. 17A, the structure is such that when the coupling member 64 is at the first position, the driven transmission portion 64*a* of the coupling member 64 and the driving transmission portion 81*a* of the drive transmission member 81 overlap in the longitudinal direction. That is, the process cartridge B can be smoothly mounted and dismounted to from the apparatus main assembly A without interference between the coupling member 64 and the drive transmission member 81 of the device main body.

When the opening/closing door 13 is closed after the cartridge B is mounted to the apparatus main assembly A, the cartridge pressing member 1 provided on the opening/closing door 13 contacts the lever member 12. The pressing of the pressing member 1 starts the movement of the lever member 12. The coupling member 64 moves from the first position (retracted position) to the drive side in interrelation with the movement of the lever member 12, the movement will be described below.

As shown in FIG. 15A, when the mounting of the process cartridge B is completed and the opening/closing door 13 is closed in the direction H in the Figure, the contact between the cartridge pressing member 1 and the lever member 12 starts, the pressing force of the cartridge pressing spring 19 begins to act on the lever member 12. By this pressing force, the lever member 12 starts to move in the K direction in the Figure against the urging force (elastic force) of the second pressing member 14. As shown in FIG. 16B, when the lever member 12 moves in the K direction, the outer cylindrical cam member 70 engaged with the lever member 12 starts to rotate in the M direction in the Figure.

The inner cylindrical cam member 74 is adjacent to the outer cylindrical cam member 70. The inner cylindrical cam member 74 is not rotatable but is capable of moving only in the axial direction. The rotation of the outer cylindrical cam member 70 in the M direction brings the cylindrical cam portion 70*b* of the outer cylindrical cam member 70 and the cylindrical cam portion 74*b* of the inner cylindrical cam member 74 to contact each other at the slanted surfaces thereof. Then, the inner cylindrical cam member 74 starts to move toward the drive side (N direction) along the longitudinal direction by the pressing force of the first pressing spring member 59. When the inner cylindrical cam member 74 moves in the N direction, the coupling member 64 pressed by the first pressing spring member 59 is also allowed to move in the longitudinal direction. By this movement of the coupling member 64, the coupling member 64 advances toward the driving side (that is, the outside of the cartridge B). Then, the driven transmission portion 64*a* of the coupling member 64 becomes engageable with the driving transmission portion 81*a* of the driving transmission member of the apparatus main body in the longitudinal direction (FIG. 17(*b*)). Further, when the opening/closing door 13 is completely closed (state of FIG. 15B), the phases of the cylindrical cam portions of the outer cylindrical cam member 74 and the inner cylindrical cam member 70 are aligned with each other as shown in FIG. 16C. At this time, the inner cylindrical cam member 74 and the coupling member 64 are placed on the most drive side by the urging force of the first pressing member 59. In this embodiment, the position where the coupling member 64 advances toward the drive side is referred to as a second displacement (advance position, outer position, engagement position, drive transmission position).

As shown in FIG. 17C, as described above, the attachment M reduces the gap M, so that the drive transmission member 81 can be prevented from tilting. Therefore, when the coupling member 64 moves to the second position, the driven transmission portion 64*a* of the coupling member 64 and the driving transmission portion 81*a* of the drive transmission member 81 can be reliably engaged.

In the embodiment, the attachment of the attachment 100 to the apparatus main assembly A and the suppressing of the tilting of the drive transmission member 81, and the resulting assured engagement between the driven transmission portion 64*a* of the coupling member 64 and the drive transmission portion 81*a* of the drive transmission member 81 have been described.

Further, referring to FIGS. 21(*a*), (*b*) and (*c*) FIG. 22, a method of fixing the attachment 100 to the guide frame R200 and a method of improving the dismountability of the attachment 100 will be described. FIG. 21A is a perspective view of the attachment 100, FIG. 21B is a cross-sectional view of the apparatus main assembly A cut by the drive transmission member 81, and FIG. 21C is an enlarged view of a longitudinal retaining portion 100*h* shown in FIG. 21B. FIG. 22 is a perspective view of the apparatus main assembly A and the attachment 100.

Regarding the method of fixing the attachment 100 to the guide frame R200, the following method can be employed in place of the above-described fixing method or in addition to the above-described fixing method. As shown in FIG. 21A, the double-sided tape 400 may be mounted to the longitudinal restriction portion 100*f* of the attachment 100 and fixed to the longitudinal restriction surface 200*b* (FIG. 8A) of the guide frame R200. In addition, as shown in FIGS. 21A, 21B, and 21C, the attachment 100 is provided with a longitudinal retaining portion 100*h* projecting outward in the radial direction with respect to the outer peripheral portion 100*b* and engaging with the portion 200*d* of the guide frame R200.

The retaining portion 100*h* is a snap fit having a cantilever structure, and can be engaged with and disengaged from the longitudinal retaining portion 200*d* by elastically deformation thereof.

Further, in order to improve the dismountability of the attachment 100 from the apparatus main body A, a hook portion 100*i* may be provided between the longitudinal regulation portion 100*f* and the projection portion 100*e* of the attachment 100, as shown in FIG. 21A.

In order to improve the stiffness of the attachment 100, a reinforcing rib 100*j* (projection) may be provided on the outer peripheral surface 100*b* of the attachment 100, as shown in FIGS. 7(*a*) and 21(*a*).

As shown in FIG. 23, when the attachment 100 is mounted to the apparatus main assembly A, if the gripping portion 100*c* of the attachment 100 projects inward in the longitudinal direction beyond the cartridge facing surface 200*e* of the guide frame R200 (FIG. 6A), interfere with cartridge B results. Therefore, the grip portion 100*c* needs to be kept outside the cartridge facing surface 200*e* (FIG. 6A) in the longitudinal direction. The shape of the grip portion 100*c* of the attachment 100 at this time satisfies the following relationship. Assuming that the diameter of the outer circumference of the attachment 100 is t, a circle having a diameter (4 t) four times as large as the outer circumference of the cylindrical portion and concentric with the cylindrical portion of the attachment 100 is drawn in a plane perpendicular to the axis of the attachment as shown in FIG. 22. Then, the entire grip portion 100*c* is included inside the circle having the diameter of 4 t. That is, the distance from the center of the cylindrical portion of the attachment 100 to an arbitrary point on the grip portion 100*c* is smaller than 2 t.

Further, the area occupied by the connecting portion 100*k* (FIG. 7A) for connecting the outer peripheral surface 100*b* and the grip portion 100*c* satisfies $x° < 90°$. That is, in the plane perpendicular to the axis of the attachment 100, the entire connecting portion 100*k* is included in an area having an angle smaller than 90 degrees with respect to the center of the attachment 100 (center of the cylindrical portion).

As described above, according to this embodiment, by mounting the attachment 100 around the drive transmission member 81, it is possible to prevent the drive transmission member 81 from tilting (parts (a), (b) and (c) FIG. 17, and FIG. 23). That is, the attachment 100 prevents the drive transmission member 81 from tilting relative to the coupling member 64 of the cartridge B. By this, the drive transmission member 81 and the coupling member 64 can be smoothly connected. In this embodiment, the coupling member 64 is connected (coupling, engaged) to the drive transmission member 81 (FIG. 17C) by the coupling member 64 movable forward and backward advancing toward the drive transmission member 81.

Both the cartridge B and the attachment 100 described above are dismountably mountable units which can be mounted to and dismounted from the image forming apparatus main assembly, and a set (combination) of the cartridge B and the attachment 100 is called an attach/dismount unit set. By selling such two dismountably mountable units in combination as a set, the user can attach the attachment 100 to the apparatus main assembly and then attach the cartridge B to the apparatus main assembly.

As shown in FIG. 17A, the relation between the inner diameter y of the inner peripheral surface 100*a* of the attachment 100 and the outer diameter z of the photosensitive drum 62 is preferably $y > z$.

As shown in FIG. 22, the distance u from the center (axis) of the cylindrical shape of the attachment 100 to the most remote point (outermost portion) of the grip 100*c* on the surface perpendicular to the rotation axis of the photosensitive drum 62 is determined. Further, the distance s from the center (axis) of the photosensitive drum 62 to the center (axis) of the developing roller 32 is determined (FIG. 3). The relationship between the distances u and s is preferably $u > s$.

As shown in FIG. 24, the cylindrical shape of the attachment 100 does not have to be a perfect cylinder. In FIG. 24, the cylinders are not completely connected over 360 degrees, and a part of the cylinder is disconnected. That is, the cylinder shown in FIG. 24 has a C shape, but such a cylinder can be regarded as a substantially cylindrical shape.

Further, a flat surface portion 100*m* (FIG. 26) may be provided on a part of the outer diameter surface 100*b* of the attachment 100. Such an attachment can also be regarded as a substantially cylindrical shape.

Further, the grip may not be provided with the through hole 100*d* (FIG. 24). Further, the grip portion 100*c* of the attachment 100 is not limited to the example of the plate shape as shown in Figure. For example, as shown in FIG. 25, the grip portion 100*c* of the attachment 100 may have a ring shape.

INDUSTRIAL APPLICABILITY

According to the present invention, an attachment, a dismountably mountable unit set, an electrophotographic image forming apparatus, and a cartridge mounting method which are useful for the electrophotographic image forming apparatus are provided.

REFERENCE NUMERALS

32 developing roller (developer carrying member)
62 drum (electrophotographic photosensitive drum)
64 coupling member
81 drive transmitting member
81*a* drive transmitting portion
81*e* outer peripheral surface
100 attachment
100*a* inner peripheral surface
100*b* outer peripheral surface
100*c* gripping portion
100*d* through hole
100*e* projection
100*f* longitudinal restriction portion
100*g* rotation restriction portion
100*h* longitudinal retaining portion
100*i* hooking portion
100*j* reinforcing rib
100*k* connecting portion
100*m* flat portion The present invention is not limited to the above-described embodiments, and various changes and modifications can be made without departing from the spirit and scope of the present invention. Therefore, the following claims are attached to open the scope of the present invention.

The present application claims priority of Japanese Patent Application No. 2018-066097 filed on Mar. 29, 2018, and the entire contents of the description thereof are incorporated herein.

The invention claimed is:

1. A mountable unit set usable with an electrophotographic image forming apparatus, the mountable unit set comprising:

(1) a cartridge that is detachably mountable to an apparatus main assembly of the electrophotographic image forming apparatus, the cartridge including (i) a photosensitive drum and (ii) a coupling member configured to receive a driving force for rotating the photosensitive drum from a driving shaft provided in the apparatus main assembly, the coupling member being movable relative to the photosensitive drum in an axial direction of the coupling member, and (2) an attachment that is detachably mountable to the apparatus main assembly, the attachment including a cylindrical portion configured to be mounted around the driving shaft and configured to suppress tilting of the driving shaft, wherein an inner diameter of the cylindrical portion of the attachment is greater than an outer diameter of the photosensitive drum.

2. A mountable unit set according to claim 1, wherein the coupling member is movable forward and backward.

3. A mountable unit set according to claim 1, wherein the attachment is provided with a grip portion extending from the cylindrical portion in a radial direction of the cylindrical portion.

4. A mountable unit set according to claim 3, wherein the grip portion is provided with a projection projecting in an axial direction of the cylindrical portion.

5. A mountable unit set according to claim 3, wherein the grip portion is provided with an opening.

6. A mountable unit set according to claim 3, wherein an entirety of a connecting portion between the cylindrical portion and the grip portion is within a range of less than 90 degrees about an axis of cylindrical portion in a plane perpendicular to the axis of the cylindrical portion.

7. A mountable unit set according to claim 3, wherein the attachment includes a double-sided tape mounted to the grip portion.

8. A mountable unit set according to claim 1, wherein the attachment includes a double-sided tape.

9. A mountable unit set according to claim 1, wherein the cylindrical portion is provided with a retaining portion for preventing the attachment from disengaging from the electrophotographic image forming apparatus.

10. A mountable unit set according to claim 1, wherein the cylindrical portion has a snap fit.

11. An electrophotographic image forming apparatus comprising:

an electrophotographic image forming apparatus main assembly including the driving shaft; and the mountable unit set according to claim 1 detachably mounted to the apparatus main assembly.

* * * * *